US007389605B1

(12) United States Patent
Clark

(10) Patent No.: US 7,389,605 B1
(45) Date of Patent: Jun. 24, 2008

(54) SELF CLEARING SINGLE AND/OR MULTIPLE SHELL CATCHING DEVICE

(76) Inventor: R. John Clark, 5005 Cornish Heights Pkwy., Syracuse, NY (US) 13215

( * ) Notice: Subject to any disclaimer, the term of this patent is extended or adjusted under 35 U.S.C. 154(b) by 13 days.

(21) Appl. No.: 11/522,176

(22) Filed: Sep. 15, 2006

(51) Int. Cl.
*F41A 15/00* (2006.01)
*F41A 9/00* (2006.01)

(52) U.S. Cl. ..... 42/98; 89/33.4

(58) Field of Classification Search ..... 89/33.4; 42/98

See application file for complete search history.

(56) References Cited

U.S. PATENT DOCUMENTS

| | | | | | |
|---|---|---|---|---|---|
| 3,087,387 | A | | 4/1963 | Browning | |
| 3,270,617 | A | | 9/1966 | Seymour | |
| 3,390,610 | A | | 7/1968 | Jordan | |
| 3,603,015 | A | | 9/1971 | Jensen | |
| 3,609,900 | A | | 10/1971 | Bernacco, Jr. | |
| 3,733,728 | A | | 5/1973 | Kuslich | |
| 3,739,685 | A | * | 6/1973 | Lundgren | 89/33.4 |
| 3,755,946 | A | | 9/1973 | Tomlinson | |
| 3,807,075 | A | | 4/1974 | Mylonas | |
| 3,881,268 | A | | 5/1975 | Peterson | |
| 3,893,253 | A | | 7/1975 | Weatherby | |
| 3,899,954 | A | * | 8/1975 | Jayne et al. | 89/33.4 |
| 3,978,602 | A | | 9/1976 | Morrow | |
| 3,984,932 | A | | 10/1976 | Morton | |
| 4,028,834 | A | * | 6/1977 | Dobson | 42/98 |
| 4,204,353 | A | * | 5/1980 | Isola | 42/98 |
| 4,384,421 | A | | 5/1983 | Rodgers | |
| 4,594,803 | A | | 6/1986 | Muncy | |
| 4,621,444 | A | | 11/1986 | Anderson | |
| 4,959,918 | A | | 10/1990 | Perez | |
| 5,138,787 | A | | 8/1992 | Riddle | |
| 5,303,635 | A | * | 4/1994 | Kowalczyk | 89/33.4 |
| 5,811,716 | A | * | 9/1998 | Ellzey | 89/33.4 |
| 6,487,808 | B1 | | 12/2002 | Carey | |
| 6,530,169 | B1 | | 3/2003 | Griffin | |
| 6,766,607 | B2 | * | 7/2004 | Castaldo | 42/98 |
| 6,836,991 | B1 | * | 1/2005 | Saur | 42/98 |
| 7,043,863 | B2 | * | 5/2006 | Saur | 42/98 |
| 7,134,233 | B1 | * | 11/2006 | Saur | 42/98 |
| 2005/0188599 | A1 | * | 9/2005 | Saur | 42/98 |
| 2006/0248776 | A1 | * | 11/2006 | Saur | 42/98 |

* cited by examiner

*Primary Examiner*—Victor Batson
*Assistant Examiner*—Michael D David

(57) ABSTRACT

A self clearing single and/or multiple spent shell catcher for use on autoloading guns comprising a plurality of pivoting spring loaded jaws with cam features which are released by a jaw trigger means and thereby catch an ejected shell. Caught shells are automatically cleared from said jaws by a reciprocating parking handle which actuates said jaws into shell catching and shell holding/stabilizing positions and places caught shells in a retention area in preparation for catching a subsequent ejected shell. The spent shell catcher removably straddles the guns ejection port by means of a plurality of dovetail like connections which are adhesively or mechanically attached to the gun and automatically position the device in proper relation to the ejection port.

7 Claims, 33 Drawing Sheets

SELF CLEARING SINGLE AND/OR MULTIPLE SHELL CATCHING DEVICE

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to spent shell or cartridge catching devices for autoloading weapons, principally for such devices which are used or useable for autoloading shotguns although the present invention is adaptable for use on other types of guns as well.

2. Prior Art

Recreational target shooting with rifles, handguns and shotguns has been popular for many years. Shotgun shooting in particular is very popular and they are used in a variety of shooting activities including hunting as well as various clay target games such as trap, skeet and sporting clays. These activities require the ability to fire a rapid sequence of shots at multiple flying or moving targets. Generally shotguns used in these activities are either autoloaders which automatically eject fired shells and chamber a live round, or multiple barreled guns which provide repeated shots by firing shells from different barrels. These multi-barreled guns are typically configured as side by sides or over/unders which terms refer to the orientation of the barrels to each other.

Multi-barreled, also known as "fixed breech" guns typically have a hinge mechanism whereby the gun can be opened to expose the breech end of the barrels from which the fired shells are then removed by the shooter and unfired shells can be inserted in their place. The gun is then closed and ready for firing.

Autoloaders however typically utilize a mechanism powered by gas or recoil energy from a fired shell which operates a moveable breech bolt to extract a fired shell from the guns chamber, eject it clear of the gun, and chamber an unfired shell for firing at the next target.

Many participants in clay target shooting also reload their own ammunition which is an enjoyable activity in itself and also provides substantial cost savings over factory loaded ammunition. In addition by reloading his or her own shells the shooter can customize various loads to maximize ballistic efficiency which can vary based upon the type and/or quality of the components used to reload a shell. Also, many shooters simply enjoy reloading as it adds to the shooters self satisfaction in allowing him or her to produce their own ammunition.

As a result many clay target shooters collect their spent shells or cartridges for reloading. In the case of multi-barreled guns, after the shells are fired the shooter opens the gun and removes the spent shell from each barrel which he or she retains for reloading later, and inserts a live shell in each barrel in order to shoot at the next series of targets.

In the case of autoloaders, also known as semi-automatics, spent shell collection is more involved. After a shell is fired it is automatically extracted from the firing chamber by the autoloading mechanism and ejected clear of the gun and onto the ground. Depending upon a number of factors, the spent shell may land on the ground some distance from the shooter. If the shooter wishes to reload these fired shells, he or she must then locate and pick them up. This results in great inconvenience to the shooter and can cause considerable delay for the shooter or others in his or her shooting party. In addition ejected shells which are not retrieved contribute to an accumulation of litter which is an undesirable environmental result.

While the use of a fixed breech gun would appear to be the logical choice for reloaders, there are distinct advantages to the use of autoloading shotguns. Typically the autoloading mechanism is driven by the gas or recoil energy generated from the fired shell. The use of this energy to power the autoloading mechanism has the very desirable effect of reducing felt recoil which reduces the often painful effect of recoil to the shooter. Also, the dissipation of energy by the autoloading mechanism in ejecting a fired shell allows the shooter to recover control of the gun more easily for a quicker and more accurate next shot. Fixed breech guns are typically significantly harder recoiling because they do not have any such mechanism which dissipates the effect of recoil. In addition depending on the magazine capacity, autoloaders typically can hold many more unfired shells for rapid shooting while fixed breach guns are typically limited to a maximum of two shots.

As a result numerous inventors have been creating shell catching devices for use on autoloading shotguns since the invention of the autoloader over 100 years ago. Efforts to perfect such a device have been persistent over that period.

Existing devices fall into four general categories. The first of these consists of devices with rigid or flexible receptacles which are positioned over or near the guns ejection port and into which spent shells are ejected. The second category consists of two pronged fork-like devices which catch a single shell between the prongs. The third category are those devices which restrict the guns ejection port and thereby trap a single spent shell as it is partially ejected. The fourth category of devices are not true shell catchers, but merely deflect the spent shell as it is ejected from the gun.

U.S. Pat. No. 6,530,169 issued Mar. 11, 2003 to Frederick M. Griffin describes a rigid cage-like device which is pivotally attached to the exterior of the gun and covers the ejection port thereby catching shells ejected upon firing. The device is bulky and therefore obtrusive and must be pivoted out of position to cock and load the gun and otherwise access its internal mechanism.

U.S. Pat. No. 4,594,803 issued Jun. 17, 1986 to Floyd B. Muncy also describes a bulky container which covers the ejection port and is mounted on a large hinged bracket. The container must pivot forward to provide access to the ejection port for cocking, loading and otherwise accessing the guns internal mechanism.

The foregoing are examples of the rigid container versions of current devices.

U.S. Pat. No. 4,959,918 issued Oct. 2, 1990 to Kenneth M. Perez describes a combination deflector and associated bag-like device detachably mounted to the gun opposite the guns ejection port and into which fired shells are ejected. The device is large and awkward to use and interferes with the shooters ability to load and cock the gun.

U.S. Pat. No. 5,138,787 issued Aug. 18, 1992 to Ronald E. Riddle, et al. describes a similar deflector and bag-like device for catching and holding ejected rifle casings.

The foregoing are examples of the bag like devices in this category. All of the above rigid or bag-like devices, although in theory permitting the shooter to fire multiple shells, consist of bulky receptacles which impair the shooters ability to sight down the barrel and/or track a moving target while the gun is mounted to fire. They also have the added disadvantage of altering the guns dynamic balance and generally being obtrusive and unattractive. Furthermore they all completely obstruct the ejection port and thereby interfere with the shooters ability to cock and load the gun and otherwise access the guns features. They also require large unappealing clamps, frames and/or bolts to attach them to the gun.

U.S. Pat. No. 3,270,617 issued Sep. 6, 1966 to Ralph V. Seymour describes a two pronged fork-like device which replaces the guns breech bolt operating handle. The device reciprocates back and forth as the bolt moves through the firing cycle. A single ejected shell is caught between the prongs or arms of the fork as it moves rearward over the ejection port as the bolt cycles. The ejected shell and forks then move forward and stop in the guns foreend area where it is then removed by the shooter before the next shot is taken. This device is unreliable and is a potential cause of injury to the shooter due to its rapid oscillation.

U.S. Pat. No. 3,087,387 issued Apr. 30, 1963 to Val Browning also describes a two pronged fork-like device which is mounted on the side of the gun. The flexible arms longitudinally straddle the ejection port and the distance between the arms is somewhat less than the diameter of the shell being used in the gun. As the fired shell is ejected from the gun it spreads and is trapped between the arms. The fired shell is then removed from the device by the shooter before the next shell can be fired.

These fork like devices, although smaller, lighter, and less obtrusive than the formerly discussed container type devices, can only catch a single shell and require the shooter to manually remove the spent shell from the device before the next shot is fired. Also, as in the case of a Seymour like device, the reciprocating action imparted to the device is a source of potential injury to the shooter in that the device is rapidly moved forward of the ejection port into the foreend area where the shooters forward hand grasps the gun.

The third category of devices partially obstruct the guns ejection port and thereby traps the spent shell before it can be completely ejected from the gun.

U.S. Pat. No. 3,755,946 issued Sep. 4, 1973 to F. Kieth Tomlinson et al describes a clip on shell catcher consisting of a plate like member which detachably engages and extends somewhat above the lower margin of the guns ejection port and the lower margin of the receiver. The upper portion of the device partially obstructs the ejection port causing a single fired shell to partially jam in the ejection port where it must be removed by the shooter prior to firing the next shell. The device must be removed for multiple shots.

U.S. Pat. No. 3,881,268 issued May 6, 1975 to Clarence C. Petersen describes a U shaped member one arm of which is pivotally attached to a base which in turn is attached immediately below the guns ejection port. In operational mode the U shaped member is pivoted into position opposite the ejection port thereby reducing its effective size. The fired shell is partially trapped in the ejection port where it must be removed by the shooter prior to firing the next shell. For firing multiple shots in autoloading mode the U shaped member is pivoted so that it no longer partially obstructs the ejection port and fired shells are thrown onto the ground.

U.S. Pat. No. 3,609,900 issued Oct. 5, 1971 to William Bernocco, Jr. describes a bent rod type device which engages the upper and lower margins of the guns receiver and snaps into position. A portion of the device partially obstructs the ejection port where a fired shell is partially jammed upon ejection and removed by the shooter in order to fire the next shell. The device must be partially displaced in order to fire multiple shells in autoloading mode resulting in fired shells being ejected clear of the gun and onto the ground each time.

U.S. Pat. No. 3,390,610 issued Jul. 2, 1968 to Coy C. Jordan describes a U shaped wire or rod-like device which is inserted into holes drilled into the guns receiver immediately above and toward the rearward end of the ejection port. The device partially obstructs the ejection port serving to trap a single fired shell upon ejection which must be removed by the shooter in order to fire the next shell. The device must be removed from the gun in order to fire multiple shells in autoloading mode which are ejected clear of the gun and onto the ground each time.

U.S. Pat. No. 3,603,015 issued Sep. 7, 1971 to Kenneth W. Jensen consists of a rod slidingly mounted to a base which is attached to the side of the gun immediately rearward of the ejection port. The rod can be slid forward to partially obstruct the ejection port and thereby trap a single fired shell upon ejection which must then be removed by the shooter in order to fire the next shell. In order to fire multiple shells in autoloading mode the rod is retracted rearward of the ejection port and fired shells are ejected clear of the gun and onto the ground each time.

U.S. Pat. No. 3,893,253 issued Jul. 8, 1975 to Roy E. Weatherby et al describes a flat plate which is inserted in slots which are milled into the upper surface of the inside of the receiver and the barrel tang which connects the barrel to the receiver. So installed, the plate extends into and partially obstructs the ejection port serving to partially trap a fired shell upon ejection which must be removed by the shooter before firing the next shell. The device must be removed completely from the gun in order to fire multiple shells in autoloading mode which are ejected clear of the gun and onto the ground each time.

Some ejection port restricting type inventions employ means whereby the mounted device is automatically activated to catch a single shell or the "last in a series" of fired shells.

U.S. Pat. No. 4,384,421 issued May 24, 1983 to Lavern J. Rodgers describes a device consisting of a mounting plate attached to the side of the gun to which a blade is pivotally attached. The blade is under tension from a spring arm which holds the blade in an operative position whereby the blade partially obstructs the ejection port to partially trap a single fired shell for removal by the shooter prior to firing another shell. The device also has a locking arm which detects whether or not any unfired shells remain in the magazine. If the magazine holds any unfired shells the blade is held in an inoperative position clear of the ejection port and fired shells are ejected clear of the gun and onto the ground. When the autoloading mechanism extracts the last live shell from the magazine the blade is shifted into operative position and the last fired shell is trapped in the ejection port. Therefore the device is only capable of catching a single shell or the last in a series of shells.

U.S. Pat. No. 3,984,932 issued Oct. 12, 1976 to Thomas B. Morton describes a device capable of catching singly fired shells or, when shooting double targets, the second of two fired shells. The device consists of a spring wire hoop and loop which is attached to a metal plate which pivots on another plate attached to the gun. For singly fired shells the spring wire is positioned opposite the ejection port thereby partially obstructing it and causing the fired shell to be caught upon ejection. For double targets the device is cocked by the shooter resulting in the spring wire being held below the ejection port for the firing of the first shell which is ejected clear of the gun. The cycling of the bolt to chamber the second shell trips a latch which releases the plate to which the spring wire is attached causing it to partially obstruct the ejection port and thereby catch the second shell.

U.S. Pat. No. 3,807,075 issued Apr. 30, 1974 to Constantine Mylonas describes an ejection port restriction type device which is comprised of a convoluted plate-like member which is pivotally attached to the side of the guns receiver. The lower and forward portion of the plate like member has an extension which engages the base of the most rearward shell in the guns magazine. As the final shell in the magazine is chambered for firing, the extension no longer engages any shell and therefore the spring loaded plate like member pivots upward whereby the upper edge of the plate-like member partially obstructs the ejection port trapping a partially ejected shell. The device is only suitable for catching singly fired shells or the last in a series of shells in autoloading mode, the prior shells being ejected clear of the gun. In either case the caught shell must be removed by the shooter before the next shell is fired.

U.S. Pat. No. 3,733,728 issued May 22, 1973 to John S. Kuslich describes a wire-like catching member which is slidingly attached to a frame or casing which is mounted immediately rearward of the ejection port. The catching wire can be manually extended from the frame by the shooter to be placed in operative (extended) or inoperative (retracted) mode. In operative mode the catch wire is extended and thereby partially obstructs the ejection port to catch a singly fired shell. The device can also catch the second of two fired shells whereby the catch wire is retracted to allow the first fired shell to be ejected clear of the gun and onto the ground. The forward cycling stroke of the bolt operating handle in connection with the chambering of the second shell, engages the catch wire and extends it into operative position in order to catch the second fired shell. In either instance, caught shells must be removed by the shooter before the next shell is fired.

A fourth category of device consists of shell deflector style devices.

U.S. Pat. No. 4,621,444 issued Nov. 11, 1986 to Darryl P. Anderson describes a one piece device which replaces the bolt operating handle and extends forward of the bolt face. Upon firing, the bolt cycles rearward to eject the fired shell. As the shell is ejected from the gun it strikes the forward edge of the device and its path is deflected. Such deflection reduces the velocity of the ejected shell and directs the shell to the ground so that it does not land as far away from the shooter as it otherwise would. However the device does not catch fired shells and therefore the shooter must locate and retrieve them from the ground.

U.S. Pat. No. 3,978,602 issued Sep. 7, 1976 to Edward Lucas Morrow, et al describes a deflector style device which snaps or clips to the receiver and has a tab which extends into the ejection path of fired shells and thereby deflects them downward. This tab can also be fitted with a removable cap which increases the tabs dimensions enough so that it partially obstructs the ejection port enough so that a single fired shell is partially trapped in the ejection port. The cap is installed for singly fired shells which are then caught and individually removed by the shooter. For firing in autoloading mode the cap is removed and fired shells are deflected by the uncapped tab and ejected clear of the gun to land on the ground.

U.S. Pat. No. 6,487,808 issued Dec. 3, 2002 to Donald C. Carey describes a combination spent shell deflector and single shell catcher which consists of a plate-like member which attaches to the ejection port side of the gun. The deflector feature of the device consists of an arm which extends from the plate-like base along the upper margin of the ejection port. Near the end of the arm is a tab or finger which extends downward into the ejection path of a spent shell. Upon firing, the spent shell strikes the finger as it exits the gun and is deflected downward to the ground.

The plate-like base also incorporates a catcher which is capable of sliding vertically into operative (up) and non-operative (down) positions. In the operative position the catcher partially obstructs the ejection port where singly fired shells are partially trapped and individually removed by the shooter prior to firing the next shell. In non-operative position the catcher does not obstruct the ejection port. For firing multiple shells in autoloading mode the catcher is placed in non-operative position and spent shells are deflected downward clear of the gun by the aforementioned deflector feature.

As a review of the prior art in general and those examples specifically referenced herein demonstrates, all of the spent shell catcher and/or deflector devices heretofore known suffer from a number of disadvantages:

(a) The container/bag like devices capable of catching more than one shell in autoloading mode are all bulky and/or heavy and disrupt the dynamic balance of the firearms to which they are attached. In addition they impair the shooters sight plane making it difficult to see a stationary target or track a moving target with the gun in the mounted position. Given their innate bulk and weight these style devices are primarily suited for rifles and pistols where the size of the spent shell is small and therefore the size of the device can be reduced accordingly. Catching large spent shotgun shells requires a correspondingly large and bulky version of this style device. Because of their bulk they are not aesthetic and detract from the overall appearance of the firearm to which they are attached.

(b) The fork and ejection port restriction style devices while smaller and less obtrusive than the container style devices are only capable of catching a single shell. As a result they can not be used in those instances requiring rapid multiple shots and they must be removed from the gun or deactivated to do so. In addition devices of this type which are attached to the breech bolt present a significant threat of injury to the shooter due to rapid movement of the device imparted by cycling of the breech bolt.

(c) The deflector type devices do not catch spent shells but merely deflect them to the ground where they must be located and retrieved by the shooter.

(d) The foregoing devices are unreliable and/or their operation is distracting to the shooter, preventing his or her full concentration on the target.

(e) These devices have large awkward attachment mechanisms which can damage the guns exterior and may require special tools and/or attachment means to attach them to or remove them from the gun.

(f) These devices interfere with the shooters access to the guns features thereby interfering with the normal manner of loading and other operational features of the gun.

The shear number of prior art patents and persistence of inventors efforts since the invention of the autoloader is indicative of the ongoing unsatisfied need for a practical single and/or multiple spent shell catching device and the novelty and non-obviousness of the present invention.

OBJECTS AND ADVANTAGES

Accordingly, in addition to the objects and advantages of the single and multiple shell catcher described in my patent, the present invention has a number of other objects and advantages such as:

(a) to provide a shell catching device capable of catching single and multiple shells;

(b) to provide a shell catching device capable of catching single and multiple shells which does not require the shooter to set the device in single versus multiple catch modes.

(c) to provide a shell catching device capable of catching single and multiple shells which is small and unobtrusive and which does not impair the guns dynamic balance or impair the shooters field of vision.

(d) to provide a shell catching device capable of catching single and multiple shells which catches, collects, and retains spent shells in such a manner that they are out of the way and don't distract the shooter.

(e) to provide a shell catching device capable of catching single and multiple shells which doesn't require the shooter to remove a spent shell from the ejection port before the next shell can be fired.

(f) to provide a shell catching device capable of catching single and multiple spent shells and which automatically removes spent shells from the ejection port area and retains them in a convenient non-distracting position easily accessible to the shooter.

(g) to provide a shell catching device capable of catching single and multiple spent shells which can be correctly positioned on and attached to the gun by the average shooter without requiring the services of a gunsmith or other special abilities.

(h) to provide a shell catching device capable of catching single and multiple shells which can be easily attached to and removed from the gun without any tools and without any permanent modifications to the gun.

(i) to provide a shell catching device capable of catching single and multiple shells which does not interfere with or alter the normal manner in which the gun is loaded.

(j) to provide a shell catching device capable of catching single and multiple shells which does not interfere with or alter the shooters ability to access operational features of the gun.

SUMMARY

In accordance with the present invention a practical, light weight, unobtrusive single and multiple shell catching device for use on autoloading weapons comprising: multiple pivoting spring loaded jaws with cam features which are releasable by a triggering means and which trap and hold ejected shells; jaw cocking means; and shell clearing and retention means.

DRAWINGS

FIGS. 1 to 25

DRAWINGS

Reference Numerals

Figure 1:
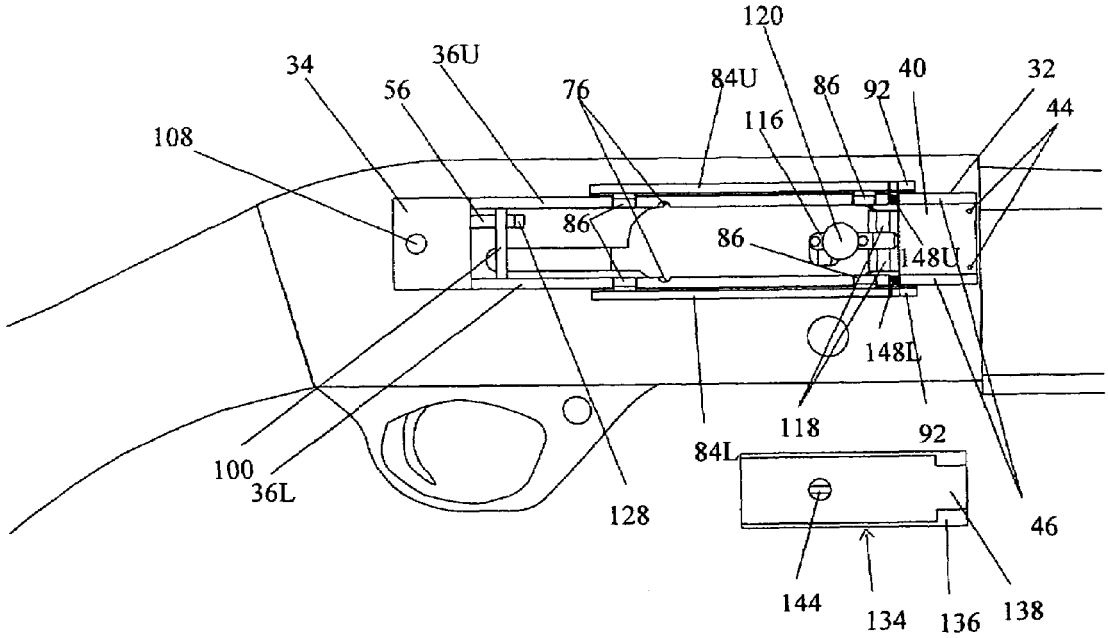
FIG. 1 shows a front orthogonal view of the invention mounted on an autoloading shotgun with mounting template also displayed.

| | |
|---|---|
| anterior base 32 | loading slots 76 |
| posterior base 34 | jaw hinge bearing surfaces 78 |
| rail 36U | torsion spring mount region 80 |
| rail 36L | parking handle threaded holes 82 |
| anterior dovetail 38 | jaw 84U |
| parking area 40 | jaw 84L |
| stops 44 | jaw hinges 86 |
| projection 46U | lips 88 |
| projection 46L | lip supports 89 |
| posterior rail holes 48 | cams 90 |
| rear spindles 50 | tab 92 |
| jaw trigger shaft holes 52 | recess 94 |
| jaw trigger shafts 54 | rest 96 |
| jaw trigger retention member 56 | jaw trigger 98 |
| posterior dovetail slot 58 | jaw trigger cross member 100 |
| posterior dovetail 60 | latch 102 |
| latch hole 62 | spring 104 |
| shaft 64 | latch channel 106 |
| grooves 66 | latch knob 108 |
| anterior rail holes 68 | latch block 110 |
| forward spindles 70 | latch tooth 112 |
| anterior dovetail slot 72 | notch 114 |
| parking handle shaft 74 | parking handle 116 |
| cam engagement arms 118 | extension 146 |
| damping material 121 | torsion spring 148U |
| rod 122 | torsion spring 148L |
| shell damping device 123 | jaw shaft 150U |
| alternate shell damping device 123A | jaw shaft 150L |
| locking nut 124 | torsion spring gap 152 |
| compression springs 126 | anterior jaw shaft bearing 154 |
| tip 128 | extension 156U |
| jaw arms 130 | extension 156L |
| base arms 132 | posterior jaw shaft bearing 158 |
| mounting template 134 | jaw trigger stops 160 |
| base 136 | inverted U shaped member 162 |
| guide 138 | slides 164 |
| studs 140 | damper compression springs 166 |
| holes 142 | damper stops 168 |
| screw 144 | bumper 170U |
| | bumper 170L |

DETAILED DESCRIPTION

FIGS. 1 through 9

Preferred Embodiment

Figure 2:
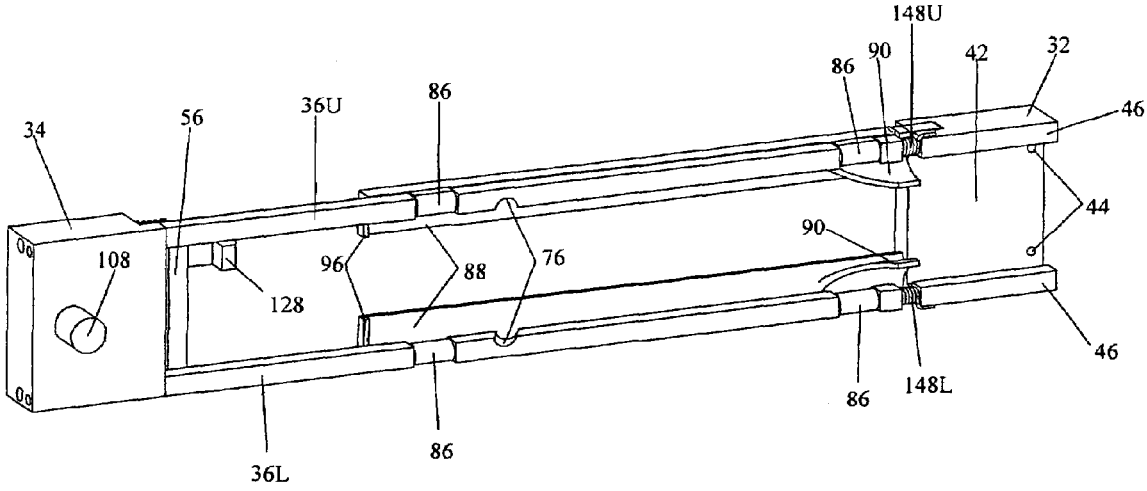
FIG. 2 shows a front perspective view of the unmounted invention without the associated parking handle with related features, showing the upper and lower jaws in the uncocked position.
Figure 3:
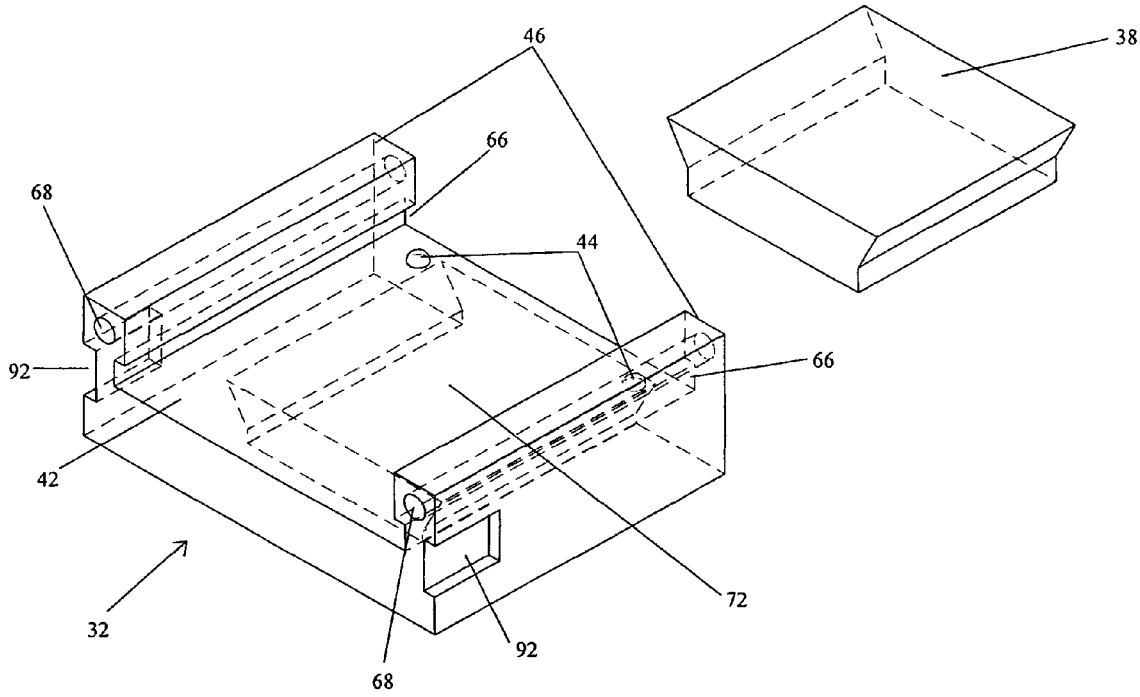
FIG. 3 shows a perspective view of the anterior base with anterior dovetail.

A preferred embodiment of the shell catcher of the present invention mounted on an autoloading shotgun is shown in FIG. 1. FIG. 2 shows a front perspective view of the preferred embodiment of the present invention, without parking handle 116 and related features, not mounted on a gun. Anterior base 32 (FIG. 3) is comprised of a rigid planar base which has a parking area 40 the forward end of which has stops 44 which consist of fixed protrusions extending upward from the anterior surface or the anterior edge of parking area 40 or alternatively a mechanical device such as a spring and ball combination which ball protrudes partially above the anterior surface of parking area 40.

The upper and lower margins of anterior base 32 have projections 46U and 46L. Part suffixes "U" and "L" are hereinafter used to refer to "upper" and "lower" respectively. The base of each projection 46U and 46L has a groove 66 along its length on the interior side at the level of parking area 40. The interior sides of projections 46U and 46L above groove 66 are of a distance apart slightly greater than the diameter of a shot shell, excluding the rim, intended for use in the gun on which the invention is to be used. The width of grooves 66 is slightly greater than the width of the rim of said shot shell. The height of each groove 66 is slightly greater than the height of the rim of said shot shell.

Above grooves 66 are anterior rail holes 68 which are of sufficient length and diameter to fixedly receive forward spindles 70 of rails 36U and 36L described below. Anterior rail holes 68 are of sufficient distance apart such that when forward spindles 70 of each rail 36U and 36L are inserted in a respective anterior rail hole 68 the opposing/inner surfaces of rails 36U and 36L are separated by a distance slightly greater than the diameter of said shot shell excluding the rim but less than the diameter of said shot shell including the rim. Anterior dovetail slot 72 is located on the underside of anterior base 32 and receivingly accepts anterior dovetail 38 which is attached to the guns receiver adhesively or mechanically as described below.

Rails 36U and 36L (FIG. 4) are comprised of rigid elongate members each with a forward spindle 70 and rear spindle 50 at its respective ends, the diameter of which is less than that of rail 36U and 36L. Each rail 36U and 36L has a single loading slot 76 cut transversely into its surface toward its rearward end. The depth, height and width of each loading slot 76 is slightly greater than the depth, height and width of the rim of a shot shell intended for use in the gun on which the invention will be used. Each rail 36U and 36L also has jaw hinge bearing surface 78 and torsion spring mount region 80. Rails 36U and 36L are of sufficient length to position anterior base 32 immediately in front of the guns ejection port and posterior base 34, described below, immediately behind the most rearward travel point of the guns operating handle in the receiver operating handle slot. The presently preferred cross-sectional shape of rails 36U and 36L is square, however round, triangular, polygonal or other shapes can be used. The presently preferred material for rails 36U and 36L is metal however any sufficiently rigid material can be used.

Jaws 84U and 84L (FIG. 4) are comprised of a lip support 89. Extending laterally from the outward margin of each lip support 89 are jaw hinges 86 which pivot around jaw hinge bearing surfaces 78 of rails 36U and 36L to pivotally attach jaws 84U and 84L to rails 36U and 36L. Extending at a right angle from the inner margin of each lip support 89 are lips 88. The forward portion of each has a cam 90 extending upward from it. The rear edge of each cam 90 is sloped. The forward margin of each lip support 89 has tab 92 extending from it which engages the side of anterior base 32 or recess 94 in the lateral surface of anterior base 32 thereby limiting the extent to which jaws 84U and 84L can close. When jaws 84U and 84L are in the fully closed/uncocked position, there is approximately a ⅛ inch gap between lips 88 and rails 36U and 36L to capture the rim of a spent shell and loosely hold the base of said shell against and more or less perpendicular to rails 36U and 36L. The rear end of each lip 88 and/or lip support 89 has rest 96 extending from it. The presently preferred material for jaws 84U and 84L is metal however plastic or other sufficiently rigid and durable material may be used.

Figure 4:
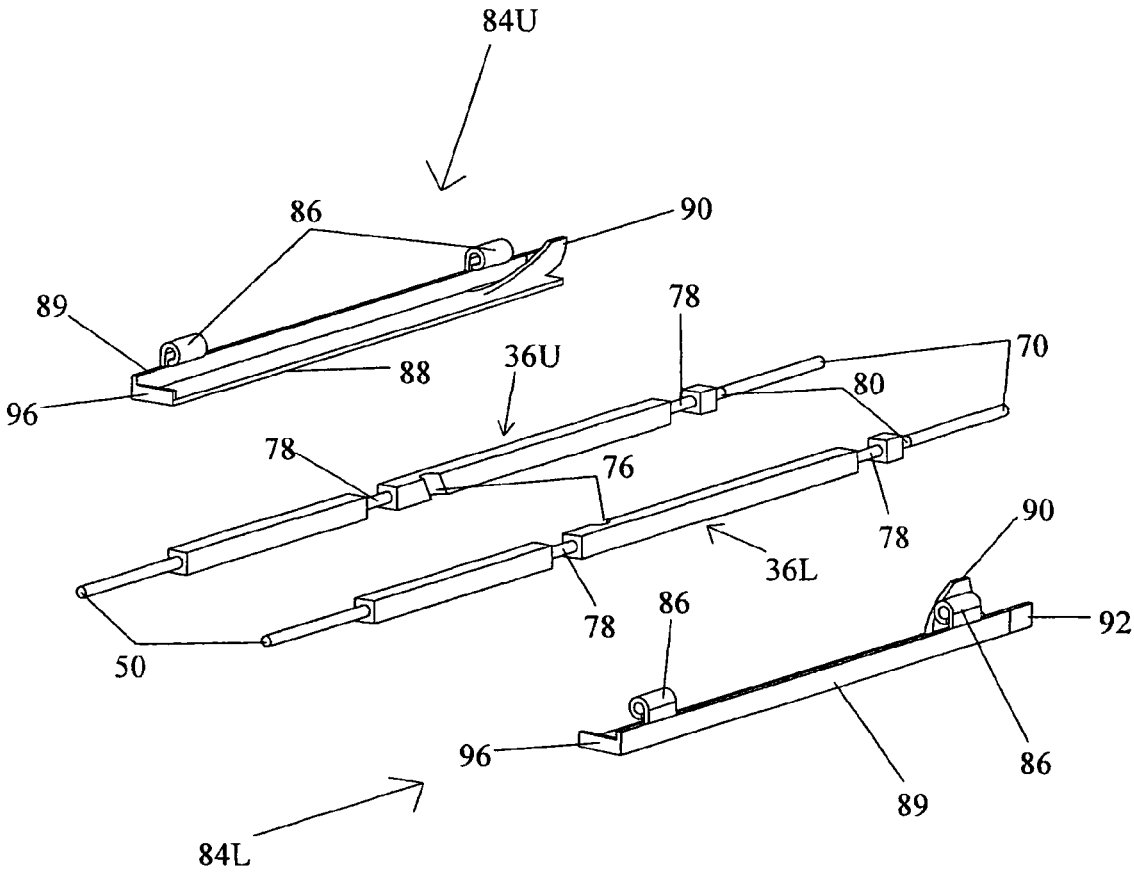
FIG. 4 shows perspective views of upper and lower rails and upper and lower jaws and the detail of their attachment.
Figure 4A:
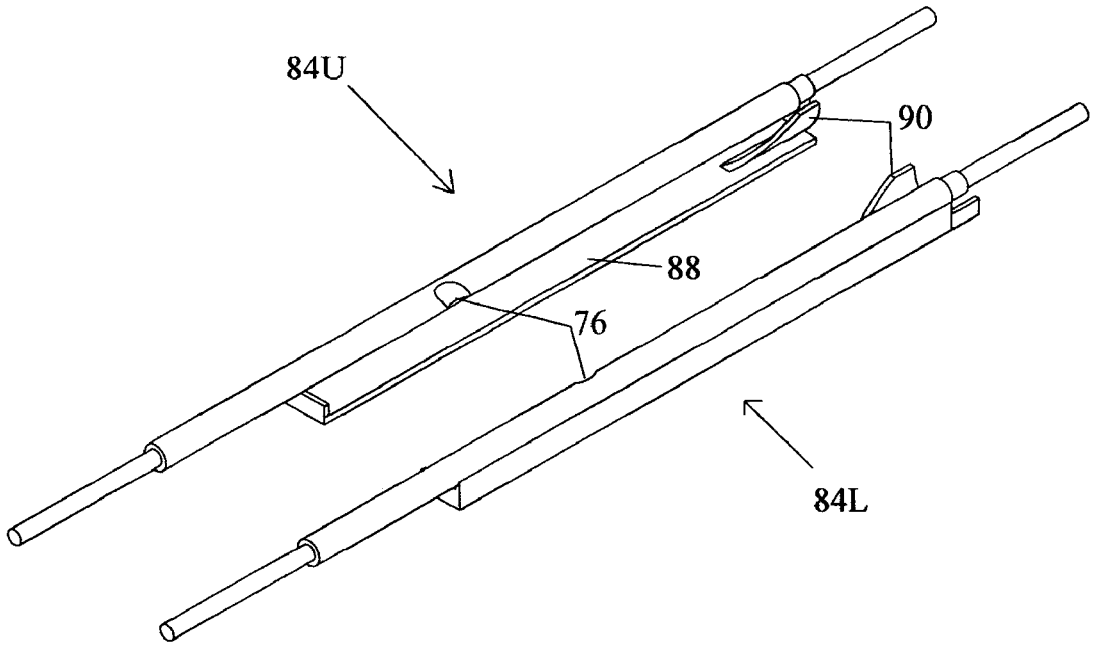
FIG. 4A shows an alternate embodiment of the upper and lower jaws which incorporates an integral axle feature and eliminates the upper and lower rails as separate structures.
Figure 5:
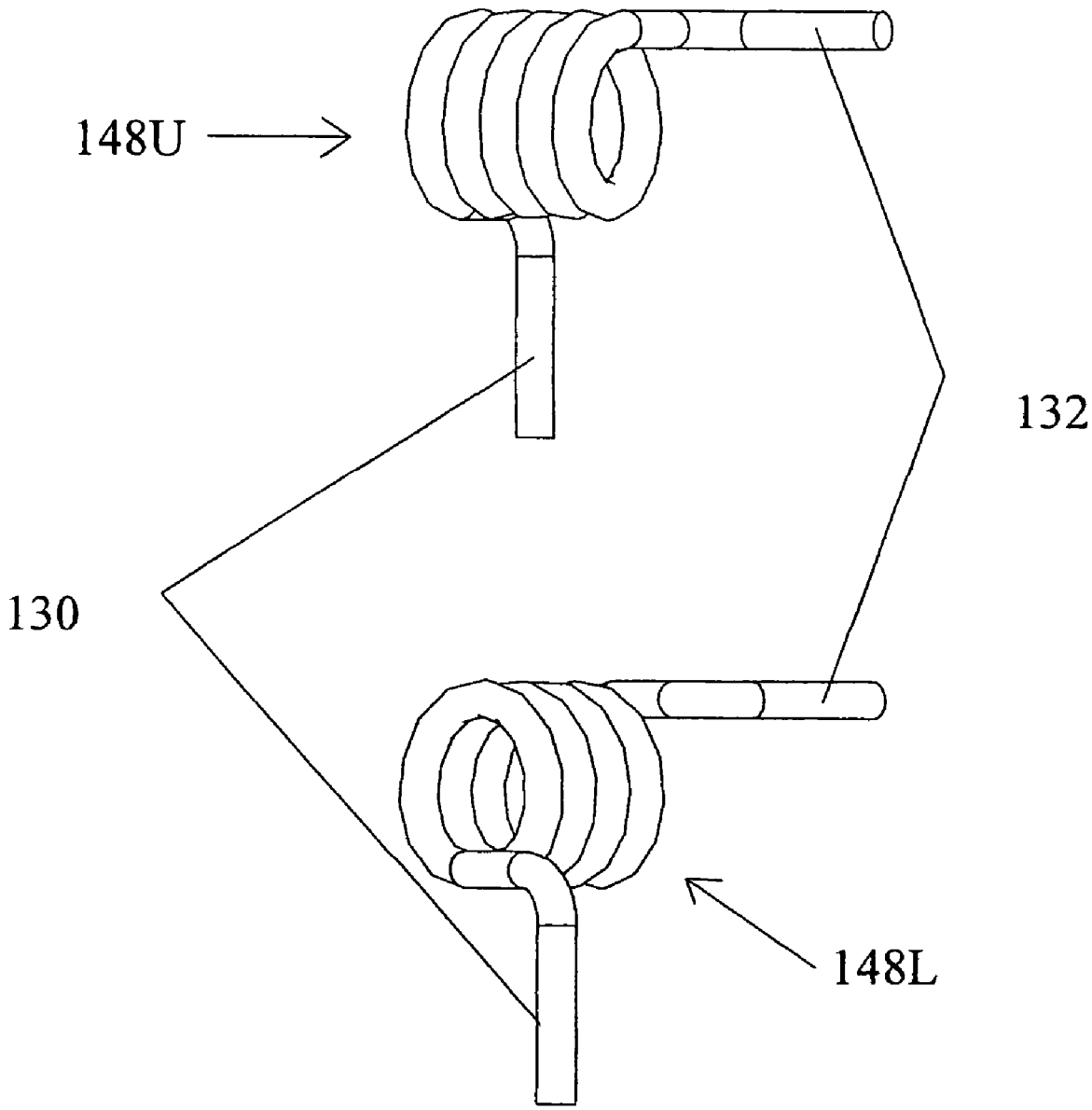
FIG. 5 shows a perspective view of the detail of upper and lower torsion springs.

Although jaws 84U and 84L, and rails 36U and 36L are described as separate structures they can be combined into a single unit. See FIG. 4A. In this configuration each jaw 84U and 84L incorporates an integral axle feature and each jaw pivots on its respective axle feature which is pivotally inserted in anterior rail holes 68 and posterior rail holes 48 described below. In this configuration the need for rails 36U and 36L is eliminated.

Torsion spring mount region 80 of each rail 36U and 36L is inserted into the center void of torsion springs 148U and 148L (FIG. 5) with jaw arm 130 engaging the outer surface of lip support 89. Base arms 132 of torsion springs 148U and 148L engage some portion of anterior base 32 and thereby hold jaws 84U and 84L closed under tension with tab 92 of each jaw 84U and 84L engaging the side of or a respective recess 94 of anterior base 32.

Posterior base 34 (FIG. 6) is comprised of a rigid planar base which has posterior rail holes 48 of sufficient length and diameter to fixedly receive rear spindle 50 of rails 36U and 36L. Posterior rail holes 48 are of sufficient distance apart such that when rear spindle 50 of each rail 36U and 36L is inserted in a respective posterior rail hole 48, the opposing/inner surfaces of each rail 36U and 36L are separated by a distance slightly greater than the diameter of said shot shell exclusive of the rim but less than the diameter of said shot shell inclusive of the rim. Again it is noted that jaws 84U and 84L can incorporate an integral axle feature as described above thereby eliminating the need for separate rails 36U and 36L as discussed above. (See FIG. 4A).

Figure 6:
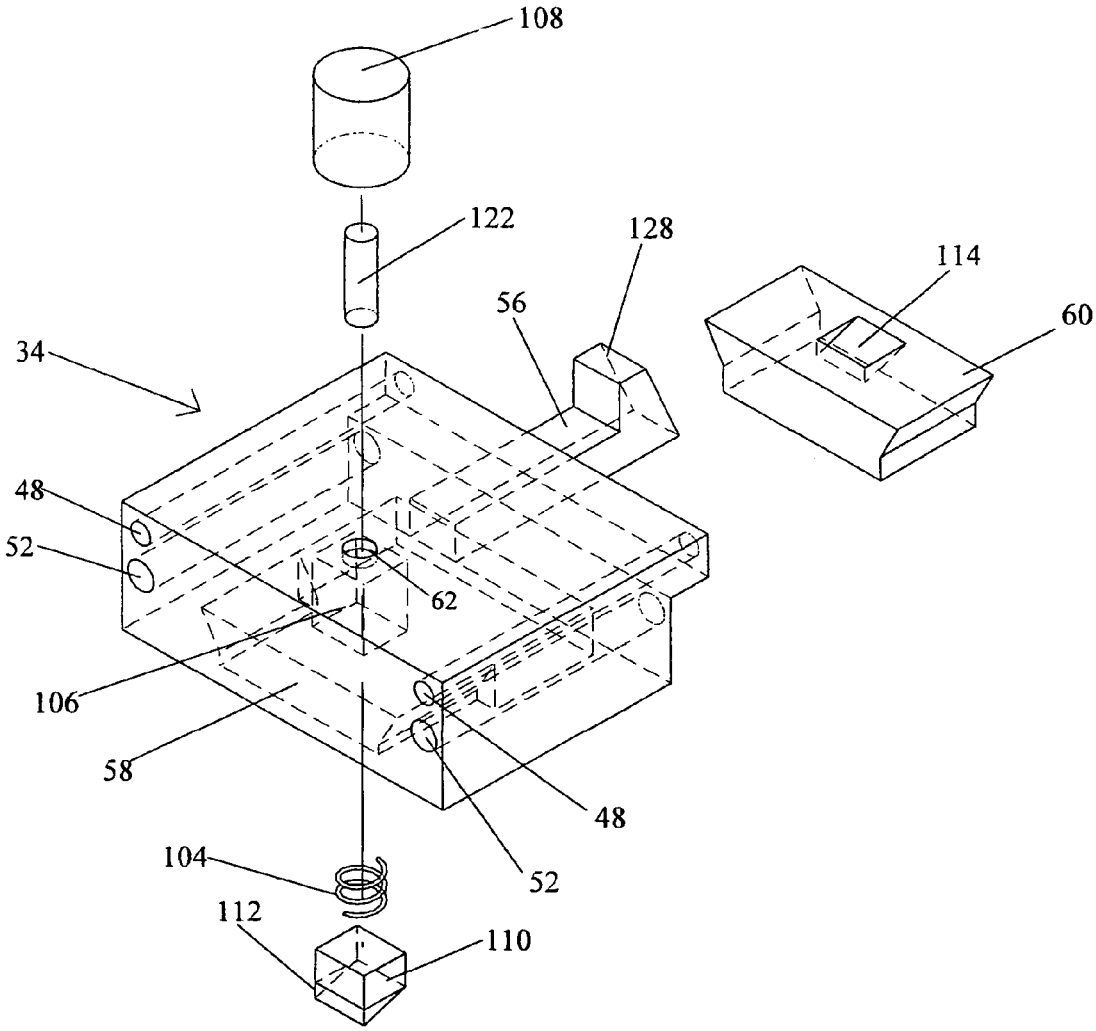
FIG. 6 shows a perspective view of posterior base and posterior dovetail and detail of the associated latch.
Figure 7:
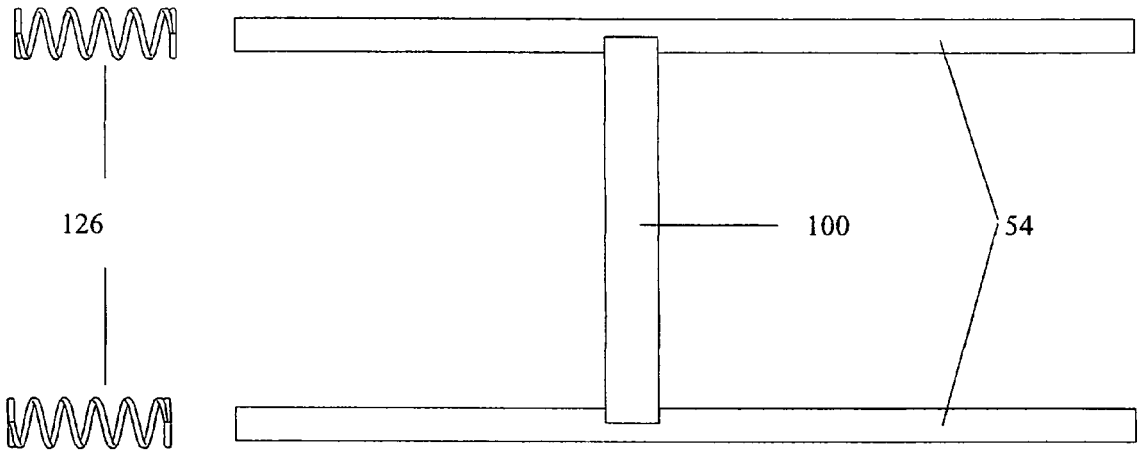
FIG. 7 shows an orthogonal view of the detail of the jaw trigger and compression springs.
Figure 8:
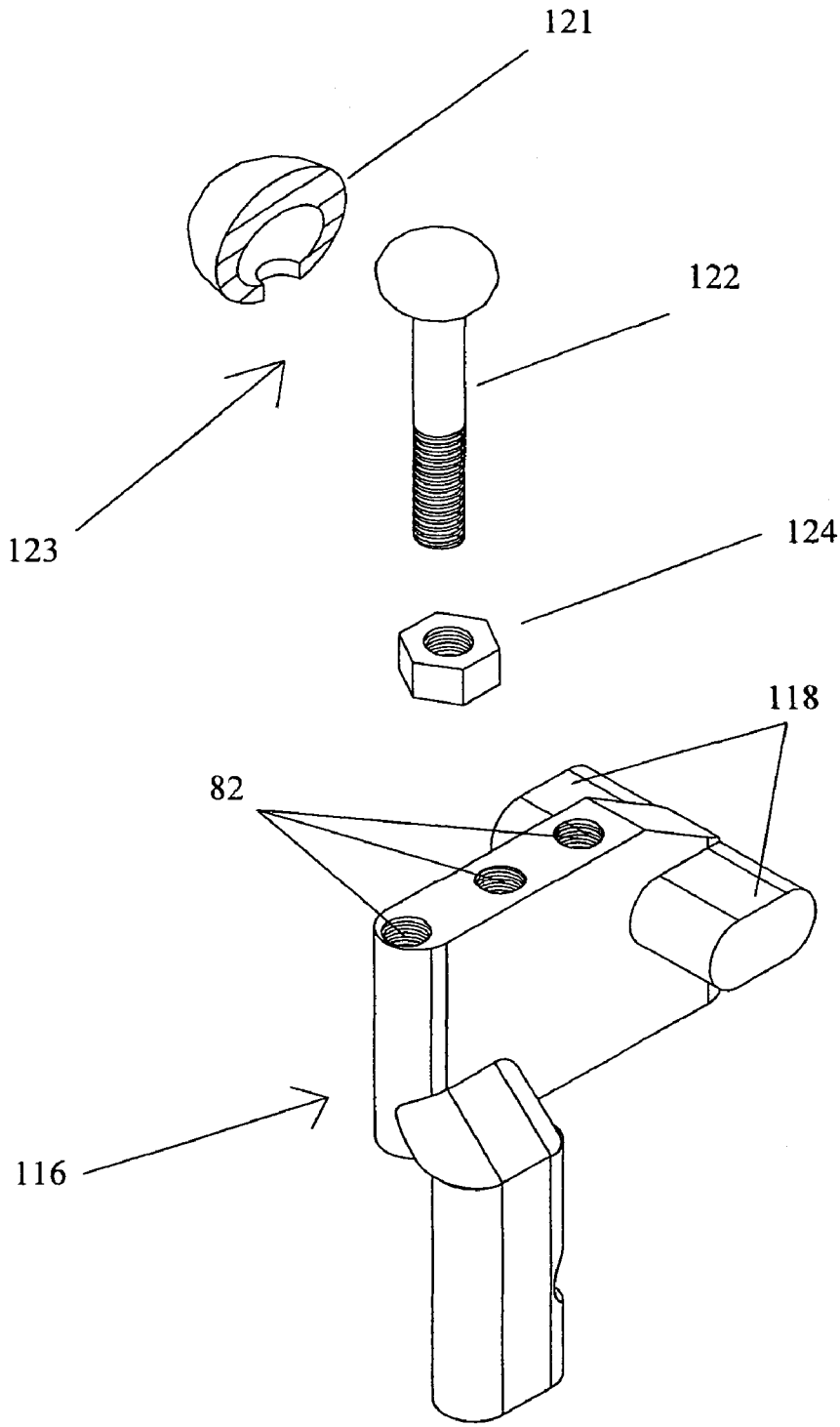
FIG. 8 shows a perspective view of the detail of the parking handle and associated shell damping device.
Figure 9:
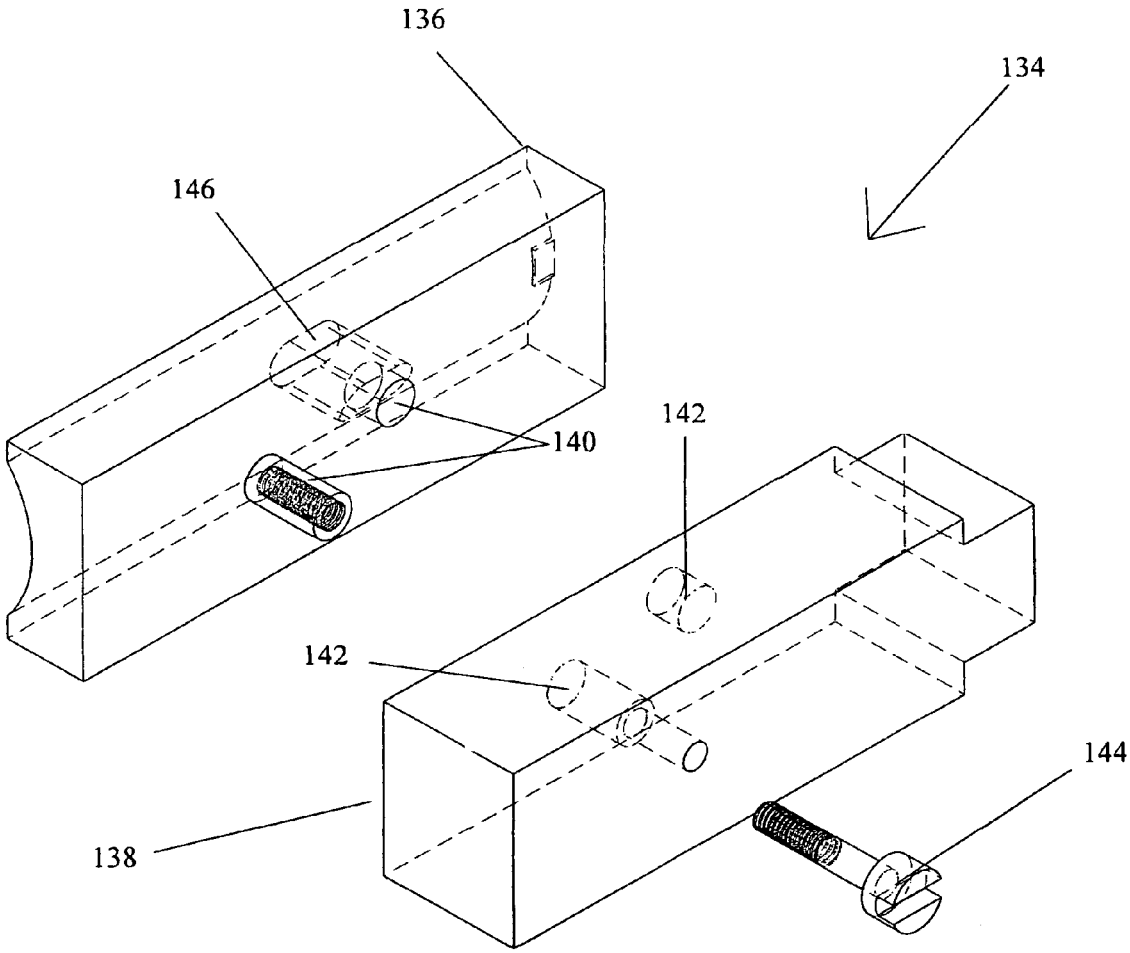
FIG. 9 shows a perspective view of the mounting template used to properly position the invention on a gun, consisting of a base and guide.
Figure 10:
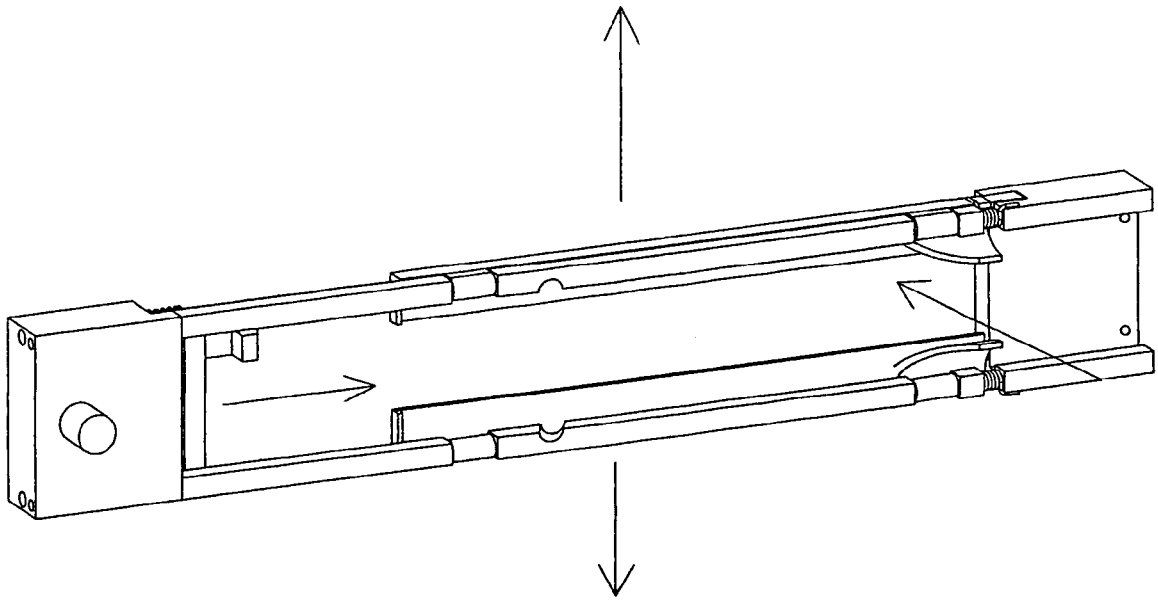
FIG. 10 shows a front perspective view of the shell catcher, without the parking handle, showing the direction of movement of various components during the cocking of the device.
Figure 11:
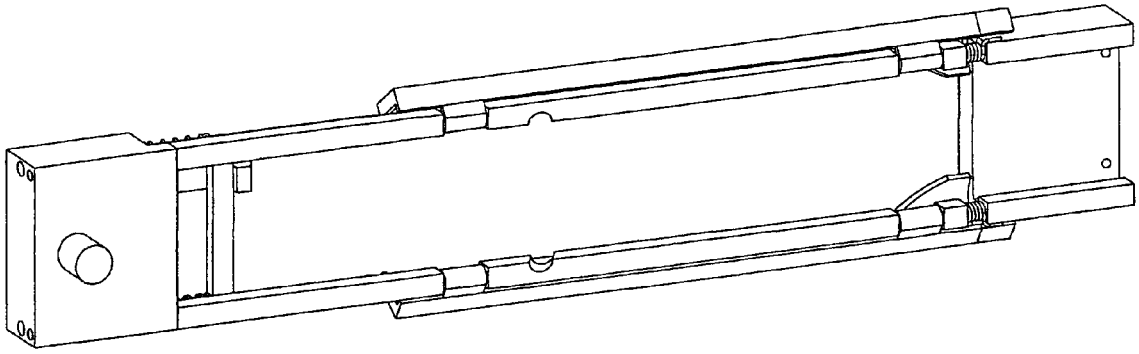
FIG. 11 shows a front perspective view of the shell catcher, without the parking handle, showing the device with the jaws in the cocked position.

Below posterior rail holes 48 are jaw trigger shaft holes 52 which are of sufficient length and diameter to receive the rearward ends of jaw trigger shafts 54 described below. The lower portion of the forward edge of posterior base 34 can be but does not have to be recessed as shown in FIG. 6 to accommodate compression springs 126. Also jaw trigger shaft holes 52 can be over bored for a portion of their length to accommodate compression springs 126. By such recessing/over boring the overall length of the invention can be reduced by the amount of the fully compressed compression springs 126.

Extending from the forward margin of the lower portion of posterior base 34 are one or more jaw trigger retention members 56. Posterior dovetail slot 58 is located on the underside of posterior base 34 and receivingly accepts posterior dovetail 60 which is attached to the guns receiver adhesively or mechanically as later described.

Latch 102 connects posterior base 34 to posterior dovetail 60 and holds the invention in place when mounted on the gun. Shaft 64 passes through spring 104, latch hole 62, and latch channel 106 in posterior base 34 and has latch knob 108 attached at its upper end and latch block 110 at its lower end. The bottom of latch block 110 has latch tooth 112 which engages notch 114 in the upper surface of posterior dovetail 60. Latch block 110 has a non-round cross sectional shape which corresponds to the shape of latch channel 106 to allow it to slide within latch channel 106 but not rotate within it in order to keep latch tooth 112 properly oriented in relation to notch 114. Pulling laterally on latch knob 108 disengages latch tooth 112 from notch 114 in posterior dovetail 60 and allows the entire device to be slid rearward for removal from the gun.

Forward spindles 70 and rear spindles 50 of rails 36U and 36L can be fixedly held in anterior and posterior base rail holes by a variety of methods such as glue, tapered circumferential ridges around forward spindles 70 and rear spindles 50 which allow insertion into anterior rail holes 68 and posterior rail holes 48 but not removal; or by appropriately sizing forward spindles 70 and rear spindles 50 and anterior rail holes 68 and posterior rail holes 48 so the fit is sufficiently tight to provide a rigid non-moveable connection; or threading forward spindles 70 and rear spindles 50 so they screw into anterior rail holes 68 and posterior rail holes 48, or by other appropriate means. Rails 36U and 36L, when mounted in anterior base 32 and posterior base 34 are oriented so that loading slots 76 are opposite and face each other. It should be noted however that if jaws 84U and 84L incorporate an integral axle feature (see discussion above and FIG. 4A) loading slots 76 will be incorporated therein, and said jaws will pivot or rotate in anterior rail holes 68 and posterior rail holes 48.

The presently preferred material for anterior base 32, posterior base 34, anterior dovetail 38, posterior dovetail 60 and latch 102 is plastic however any other sufficiently rigid material can be used. Anterior base 32, rails 36U and 36L, and posterior base 34 are described as separate parts however they can also be made as a single unit milled or machined out of a single piece of sufficiently rigid material such as metal, plastic or wood to name a few.

Jaw trigger 98 (FIG. 7) consists of an "H" shaped member comprised of jaw trigger cross member 100 which connects at more or less right angles to upper and lower jaw trigger shafts 54. The presently preferred material for jaw trigger 98 is metal, however plastic or any other sufficiently rigid and durable material may be used. The presently preferred cross sectional shape for jaw trigger cross member 100 is square and for jaw trigger shafts 54 is round however square, rectangular, triangular, polygonal or other shapes, or combinations of shapes, can be used for either.

Compression springs 126 are slipped over the rear end of jaw trigger shafts 54. The rear portion of jaw trigger shafts 54 are then inserted into the forward ends of jaw trigger shaft holes 52 of posterior base 34 until jaw trigger cross member 100 slides over tip 128 of jaw trigger retention member 56. The forward edge of tip 128 can be tapered and/or flexes to allow jaw trigger cross member 100 to pass over it to allow insertion of jaw trigger shafts 54 into jaw trigger shaft holes 52 and is of sufficient length to keep jaw trigger 98 from sliding too far forward and out of jaw trigger shaft holes 52. The rearward edge of tip 128 is not tapered and retains jaw trigger 98 under tension from compression springs 126.

Parking handle 116 (FIG. 8) replaces the guns standard bolt operating handle. It is inserted into the bolt operating handle hole and connected to the bolt in the same manner as the operating handle which is typically by means of a spring loaded ball incorporated into the bolt mechanism which seats in an indentation in the operating handle shaft and thereby holds it in the bolt operating handle hole. Typically the bolt operating handle hole and corresponding operating handle slot in the guns receiver is offset below the midline of the bolt. In such case parking handle 116 has an offset so that its upper portion is on approximately the same plane as the mid-line of the bolt. When inserted into the bolt, the forward edge of the upper portion of parking handle 116 extends forward of the bolt operating handle hole a sufficient distance so that when the bolt is closed the forward edge of parking handle 116 extends to the plane of the rear margin of anterior base 32/forward margin of the guns ejection port.

Cam engagement arms 118 extend horizontally more or less perpendicular from the forward portion of parking handle 116 at the level of rails 36U and 36L when the invention is mounted on the gun. Shell damping device 123 consists of a height and position adjustable rod 122 the lower portion of which is threaded. The upper end of rod 122 is larger than the rest of its diameter. An appropriate vibration damping/shock absorbing material 121 such as Sorbothane© is attached to the upper end of rod 122 by means of a converse void in such damping material 121 of the same internal dimensions as the external dimensions of the upper portion of rod 122 and is fitted like a cap and thereby attached. Such attachment may also be by adhesive or other appropriate means as well. Shell damping device 123 can also comprise a mechanical shock absorption/damping device as well, such as a spring loaded piston or other appropriate shock absorbing/vibration damping device. The threaded lower portion of rod 122 with locking nut 124 screws into the end of the upper portion of parking handle 116 thereby allowing for the height of shell damping device 123 to be adjusted. One or more threaded holes 82 in the upper end of parking handle 116 allows the position of shell damping device 123 to be adjusted forward or backward as well as up or down.

Mounting template 134 (FIG. 9) has two pieces, base 136 and guide 138 which are aligned by studs 140 and holes 142 which mate and are held together by screw 144. Base 136 fits within the guns ejection port and sits on top of the closed bolt. The shape of the underside of base 136 matches the external contours of the closed bolt for the particular gun on which the invention is to be mounted and also has extension 146 on its underside which is inserted into the bolt operating handle hole to further position and stabilize mounting template 134. The external dimensions of guide 138 correspond to the gap between rails 36U and 36L when jaws 84U and 84L are in the cocked or open position as described below. The forward margin of base 136 extends to the rearward edge of anterior base 32 and/or the forward edge of the guns ejection port.

Operation—FIGS. 10 through 21

The manner of attachment, use and operation of the present invention is as follows. The unloaded gun is laid on a flat horizontal surface, ejection port side facing upward. The bolt operating handle is removed and the bolt is closed by means of the bolt release.

Figure 12:
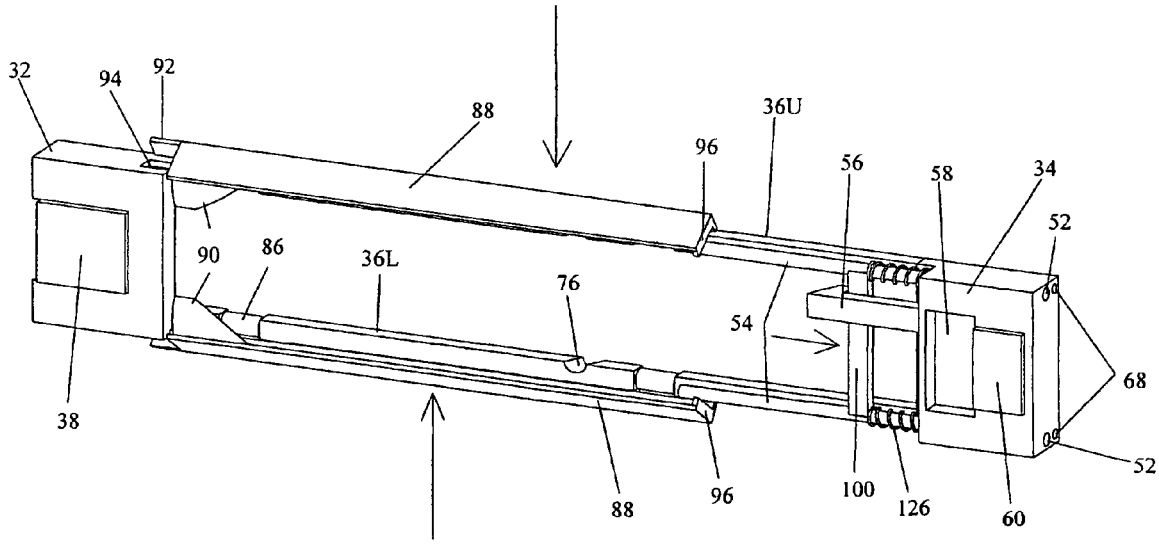
FIG. 12 shows a rear (gun side) perspective view of the invention with the jaws in the cocked position.
Figure 13:
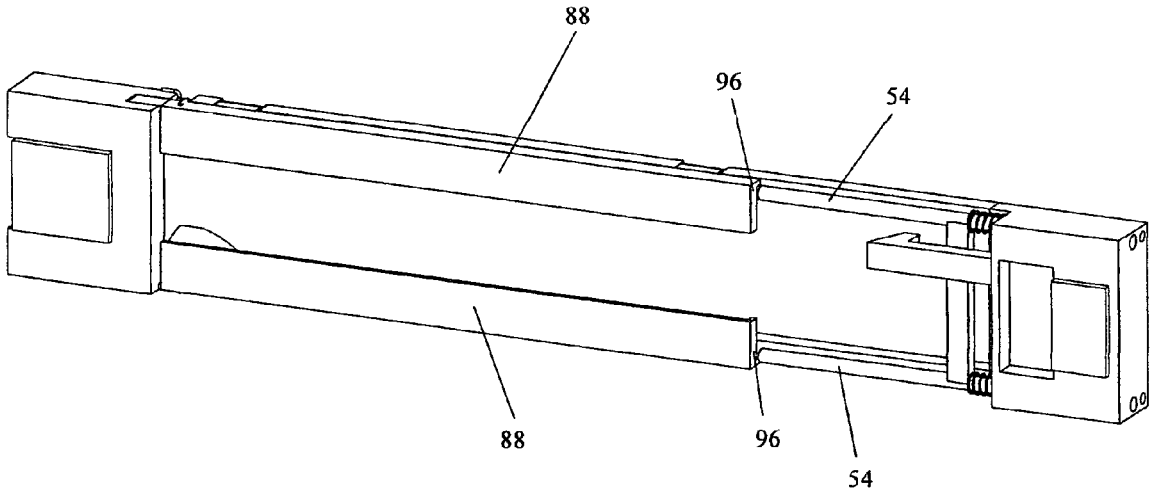
FIG. 13 shows a rear (gun side) perspective view of the invention showing the detail of the jaws in the closed or uncocked position.
Figure 14:
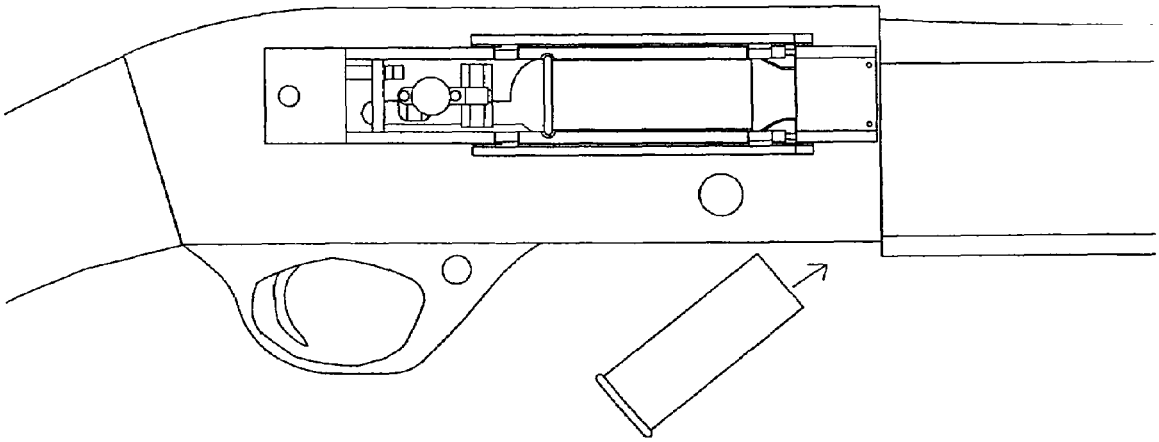
FIG. 14 shows a front orthogonal view of the loading of two shells in an autoloading shotgun with the invention mounted thereon.

Mounting template 134 with base 136 and guide 138 connected by screw 144 is placed in the ejection port on top of the closed bolt so that it is mated thereto with extension 146 inserted into the bolt operating handle hole. Double sided adhesive material, cut to size, is attached to the underside of anterior dovetail 38 and posterior dovetail 60 which are then placed in corresponding anterior dovetail slot 72 and posterior dovetail slot 58. Jaws 84U and 84L are cocked (FIGS. 10 and 11) by pressing on the upward ends of cams 90 which causes jaws 84U and 84L to axially pivot. Jaws 84U and 84L are held in the open or cocked position by the forward ends of jaw trigger shafts 54 which are driven forward and underneath lip supports 89 and rests 96 by compression springs 126 when cams 90 are depressed sufficiently. (FIG. 12). When jaws 84U and 84L are in the closed or fired position, jaw trigger 98 is held rearward by the alignment and engagement of the forward ends of jaw trigger shafts 54 with the rear edge of lip supports 89 and/or rests 96 (FIG. 13).

The invention is then lowered on to mounting template 134 which guides the invention into proper position over the ejection port. The adhesive backed dovetails/invention combination is then pressed against the gun, securely attaching the device in proper alignment over the ejection port.

Screw 144 is then removed disconnecting base 136 from guide 138. Guide 138 is withdrawn upwards through rails 36U and 36L. Latch knob 108 is then pulled laterally thereby disengaging latch tooth 112 from notch 114 and releasing the invention from posterior dovetail 60, allowing the invention to be slid rearward and removed from the gun while anterior dovetail 38 and posterior dovetail 60 remain adhesively attached to the gun. Base 136 is then removed from the ejection port and bolt area. The invention is then reattached to the gun by aligning anterior dovetail slot 72 and posterior dovetail slot 58 with anterior dovetail 38 and posterior dovetail 60 and sliding the invention forward to engage said dovetails and slots so that latch tooth 112 engages notch 114 in posterior dovetail 60, firmly attaching the invention to the gun. Parking handle 116 with shell damping device 123 attached is installed in the bolt operating handle hole and the bolt is "opened" or cocked by the shooter in the normal manner.

When cocking the bolt, if it is pulled back far enough jaw trigger cross member 100 may be engaged by parking handle 116 and thereby release jaw 84U and jaw 84L which must then be recocked. When the bolt is at rest in the open position, parking handle 116 is forward of the point which would cause jaw trigger 98 to release jaw 84U and jaw 84L.

Figure 25:
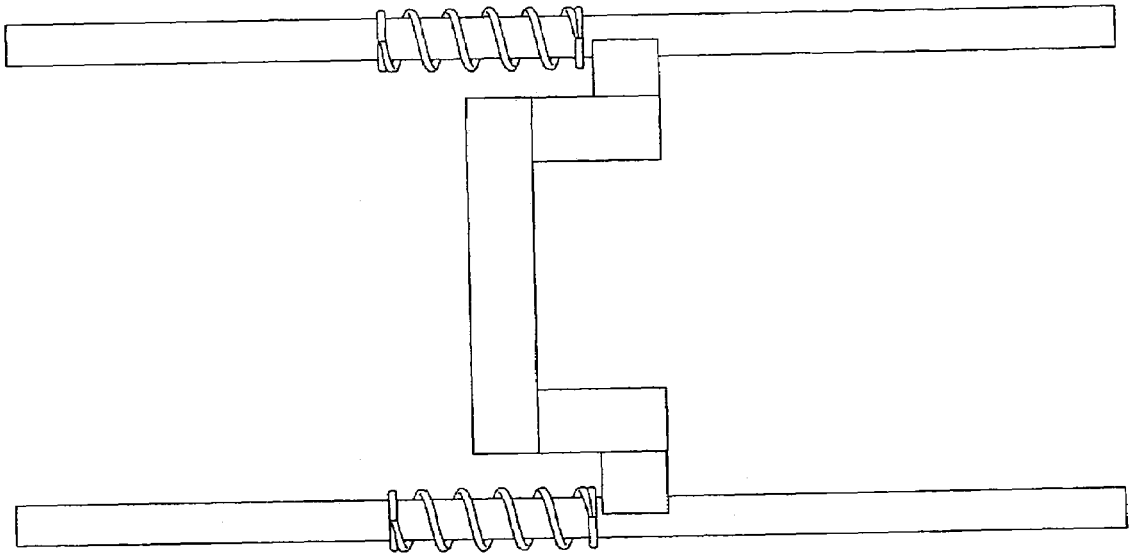
FIG. 25 shows an alternate embodiment of the jaw trigger with associated compression springs.

Most clay target games allow a maximum of two (2) shots at a single target or in the case of a "double" target launch, one shot at each of two targets. Therefore the following description contemplates a maximum of two shells being loaded in the gun. In hunting three (3) or more rapid shots might be required in which case anterior base 32 would have to be extended accordingly in order to retain the additional shells (See FIG. 25).

To load the gun (FIG. 14) an unfired shell is placed into the receiver by aligning the rim of the base of the shell with loading slots 76 and dropping the shell through rails 36U and 36L, cocked jaws 84U and 84L and the ejection port. The bolt release is pressed to close the bolt and chamber the shell and a second shell is loaded into the magazine in the usual manner.

Figure 15:
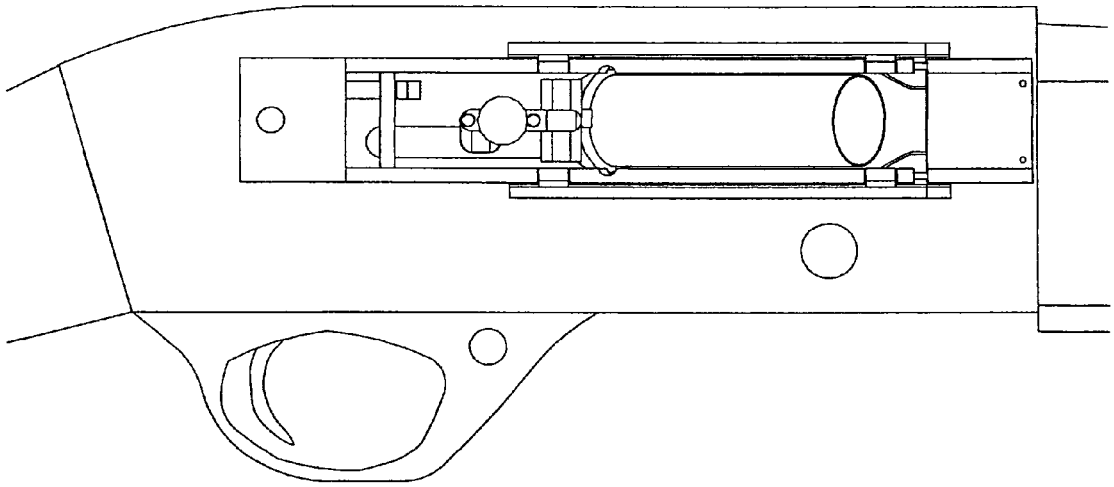
FIG. 15 shows a front orthogonal view of the extraction and partial ejection of a spent shell from an autoloading shotgun with the invention in place.
Figure 16:
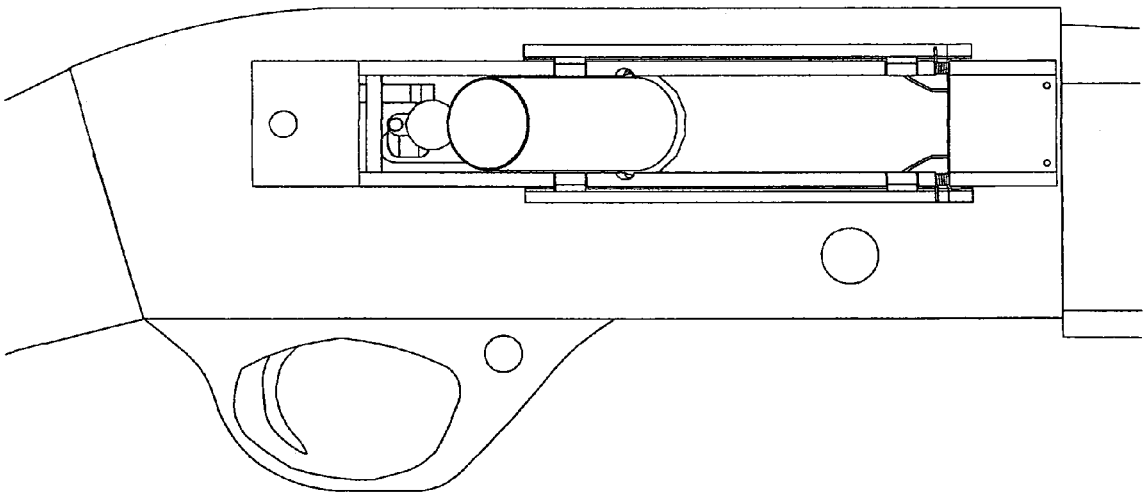
FIG. 16 shows a front orthogonal view of the ejection of a spent shell from the gun and the engagement of the rim of the spent shell with the inventions upper and lower rails as the jaw trigger releases the jaws.
Figure 17:
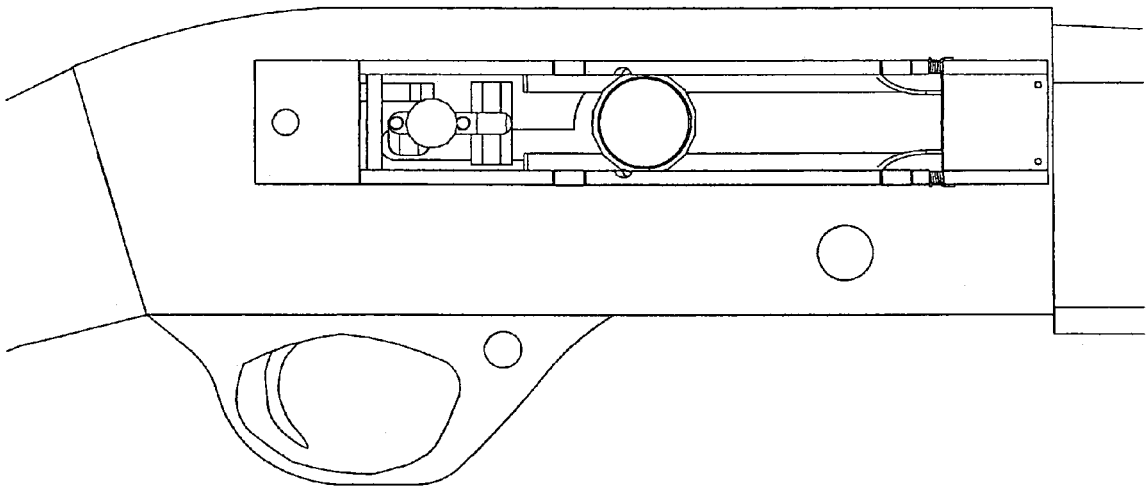
FIG. 17 shows a front orthogonal view of the spent shell held against the rails by the inventions released jaws.
Figure 18:
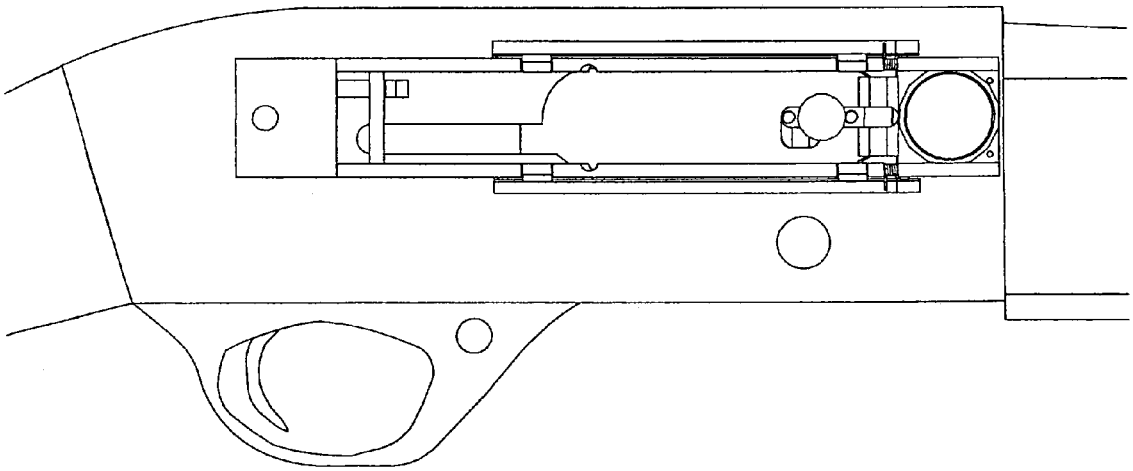
FIG. 18 shows a front orthogonal view of the caught shell after having been parked in the parking area by the parking handle.

Upon firing the first shell the bolt travels rearward and extracts the fired shell from the chamber. Towards the rearward end of this extraction/ejection stroke the rim of the spent shell engages the ejector within the receiver (not shown) causing the mouth of the fired shell to rotate up through the ejection port, and between cocked jaws 84U and 84L and rails 36U and 36L (FIG. 15). The spent shell continues to rotate over the back of and out of the ejection port and its rim engages rails 36U and 36L and its upper portion impacts shell damping device 123 dissipating some rotational energy (FIG. 16). At about the same time the rearward edge of parking handle 116 engages jaw trigger cross member 100 driving jaw trigger 98 rearward thereby releasing jaws 84U and 84L which close with lips 88 engaging the bottom of the spent shell and stabilizing it against rails 36U and 36L (FIG. 17). When jaws 84U and 84L are in the fully closed/uncocked position, there is approximately a ⅛ inch gap between lips 88 and rails 36U and 36L to capture the rim of the spent shell and loosely hold the base of said shell against and more or less perpendicular to rails 36U and 36L.

Figure 19:
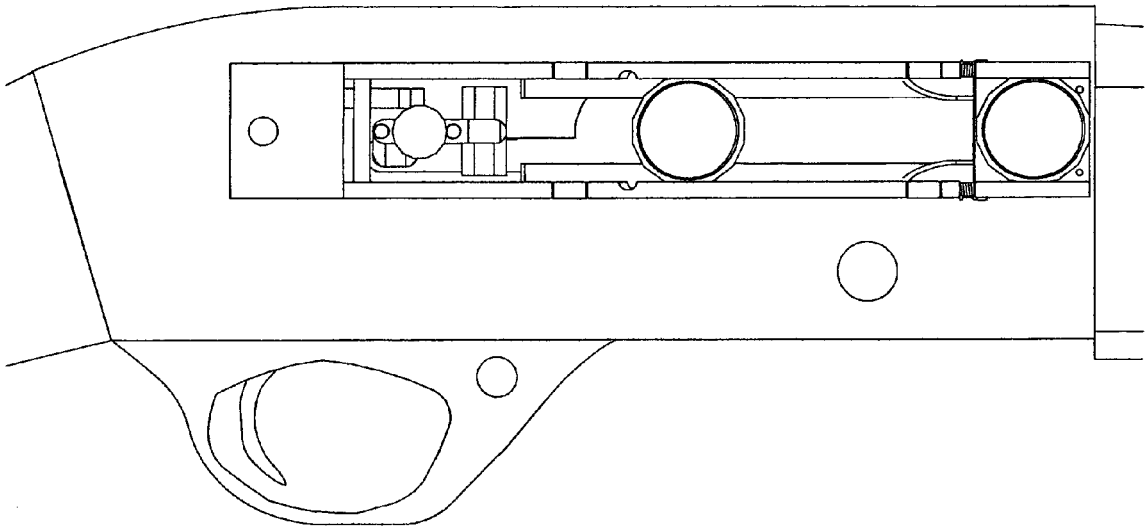
FIG. 19 shows a front orthogonal view showing the second spent shell held against the rails by the inventions released jaws with the bolt locked in the open position.

After completion of the extraction/ejection stroke, parking handle 116 moves forward (FIG. 18) as the bolt chambers the next live shell and in so doing parking handle 116 engages the now stabilized spent shell which is held against rails 36U and 36L by jaws 84U and 84L and pushes the spent shell forward along rails 36U and 36L. Near the end of this cocking/chambering stroke the rim of the spent shell engages cams 90 causing jaws 84U and 84L to pivot axially from the closed position thereby releasing the forward ends of jaw trigger shafts 54 which then slide forward and under lip supports 89 and rests 96 thereby holding jaws 84U and 84L in the open or cocked position for the next shot. At the forward end of the cocking/chambering stroke the spent shell is pushed into parking area 40 by parking handle 116 and is held there by stops 44 on the front, and parking handle 116 and the forward edge of cams 90 on the back, which when cocked still extend somewhat above the level of parking area 40. The entire sequence is repeated upon firing the second shell. The last fired shell is held against rails 36U and 36L by jaws 84U and 84L as typically an autoloaders bolt locks in the open position after firing the last shell, leaving jaws 84U and 84L in the uncocked or closed position holding the last fired shell against and perpendicular to rails 36U and 36L (FIG. 19).

Figure 20:
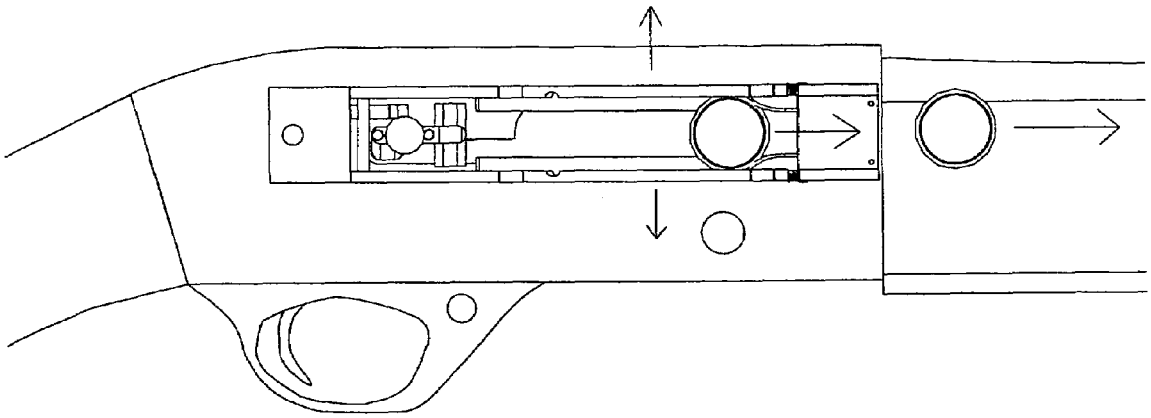
FIG. 20 shows the direction of removal of the spent shells from the invention.

The spent shells, one in parking area 40 and another held against rails 36U and 36L by jaws 84U and 84L, are then manually removed by the shooter. The first fired shell is slid forward out of parking area 40. The second fired shell is slid forward along rails 36U and 36L by the shooter. As it approaches anterior base 32 it's rim engages cams 90 which then rotate jaws 84U and 84L axially which are thereby cocked and held in the open or cocked position by the forward portion of jaw trigger shafts 54 as previously described. The second shell is then slid into the rear of parking area 40 and out its front, leaving the invention cocked and ready for reloading. (FIG. 20)

Figure 21:
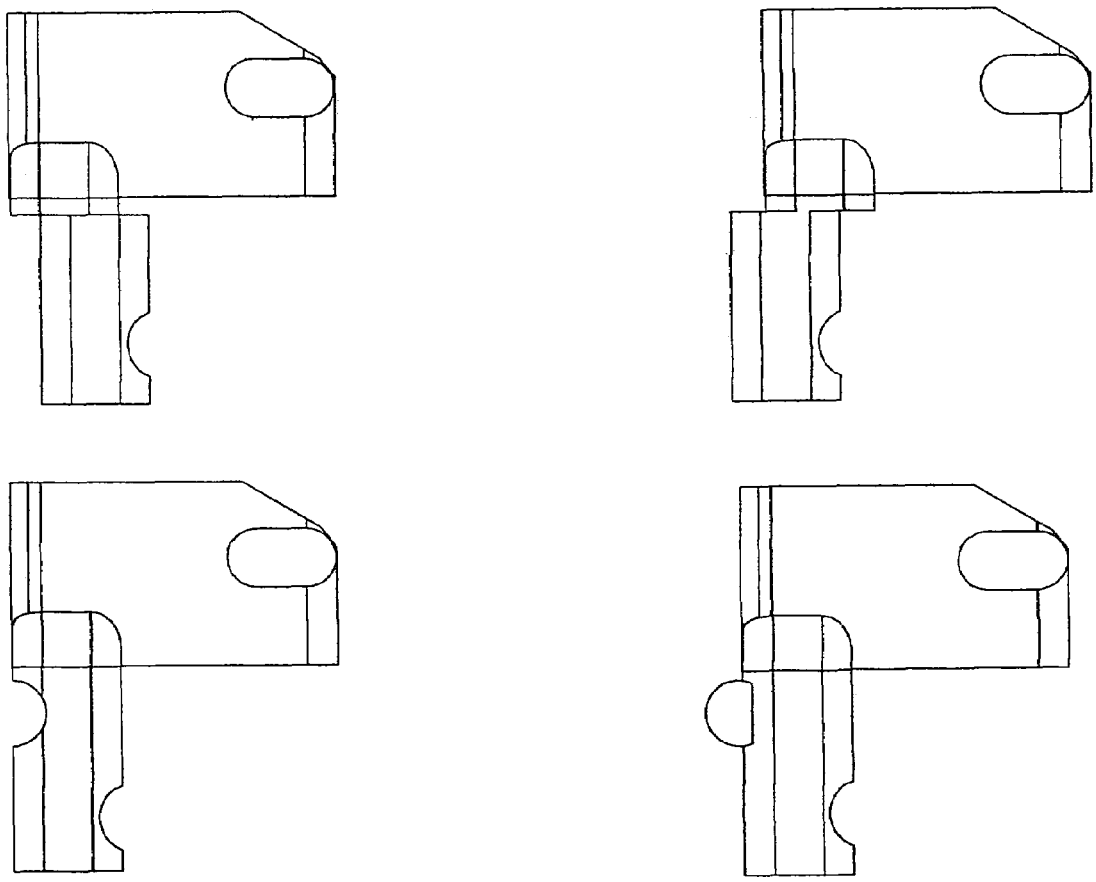
FIG. 21 shows an orthogonal view of the detail of the parking handle with offsets and other features to change the timing of the release of the jaw trigger by the parking handle.

The timing of the release of jaws 84U and 84L can be adjusted by offsetting the shaft of parking handle 116 forward or backward or by other means such as protrusions or indentations on the rear edge of parking handle shaft 74 or forward edge of jaw trigger cross member 100 or other appropriate means. (FIG. 21)

The force with which spent shells are ejected from an autoloader can vary depending upon a particular shotguns design as well as the type of shell being fired. Some autoloaders throw ejected shells quite a distance while others throw them only a few feet. Target shells typically use lighter "payloads" of shot with a lower muzzle velocity than hunting loads and therefore are typically not ejected with as much force as a spent hunting shell. The more tension exerted on jaws 84U and 84L by torsion springs 148U and 148L, the quicker a spent shell is stabilized against rails 36U and 36L. If too little tension is applied to jaws 84U and 84L a spent shell can oscillate back and forth and in so doing cause jaws 84U and 84L to partially open. If a spent shell is not stabilized before it is engaged by parking handle 116 on the bolt closing stroke a jam may result. The stabilizing effect of torsion springs 148U and 148L on jaws 84U and 84L can be augmented by angling the forward ends of jaw trigger shafts 54 and rests 96 so that in opening jaws 84U and 84L, jaw trigger 98 is driven or "cammed" rearward slightly thereby invoking the tension from compression springs 126 to help keep jaws 84U and 84L closed once a spent shell has been caught.

Depending on the gun and shell combination, shell damping device 123 may not be necessary for the invention to work properly. In the event its use is desired, the damping effect on the amount of rotation and retained energy of an ejected shell can be regulated by adjusting the position and the height of shell damping device 123 by means of the threaded lower portion of rod 122 and locking nut 124. The higher and more forward the position of shell damping device 123, the sooner the rotating fired shell is engaged and the sooner its rotation is interrupted and the less rotational energy is retained. If shell damping device 123 is positioned too high and/or too forward the fired shell may not retain sufficient lateral rotational energy to completely exit the ejection port so that its rim does not engage rails 36U and 36L thereby potentially causing a jam on the next shot. Vibration damping/shock absorbing material 121 can also be attached directly to the upper surface of parking handle 116 by adhesive or other means without an intervening rod 122 and locking nut 124. If shell damping device 123 is positioned too low and/or too rearward, the fired shell may retain too much lateral rotational energy such that jaws 84U and 84L can not stabilize the fired shell against rails 36U and 36L in sufficient time before parking handle 116 moves forward resulting in a jam, or the shell could pass completely through rails 36U and 36L as described below.

The retained energy of the fired shell can also be regulated by appropriate timing of the release of jaws 84U and 84L by jaw trigger 98. By adjusting this release point by offsetting parking handle 116 or other means as set forth above, jaw release can be timed to occur after the mouth of the fired shell passes through the open and cocked jaws but before the base of the fired shell passes completely through the closing and uncocked jaws. In this way the release of jaws 84U and 84L can be timed to close on the sides of the fired shell such that the torsion spring tension exerted on the jaws "squeezes" the fired shell as it passes through, thereby dissipating energy. Jaw release timing and/or torsion spring tension may have to be adjusted so that too much energy isn't dissipated such that the base of the shell is prevented from passing completely through jaws 84U and 84L thereby preventing the rim from engaging rails 36U and 36L and potentially causing a jam.

In the case of a particularly vigorous ejection it is possible that rails 36U and 36L could flex enough from the impact of the spent shell such that the ejected shell passes completely through the rails and therefore the spent shell can not be used to cock jaws 84U and 84L on the forward stroke of parking handle 116 thereby potentially causing a jam upon firing the next shell. In this situation cam engagement arms 118 provide a jaw cocking failsafe by engaging cams 90 on the bolt closing stroke and thereby cocking jaws 84U and 84L without the necessity of a spent shell being pushed along rails 36U and 36L. Cam engagement arms 118 are not essential to the operation of the invention, but in the event a fired shell is ejected completely through the rails, a jam on the next shot is averted by their use.

Figure 22:
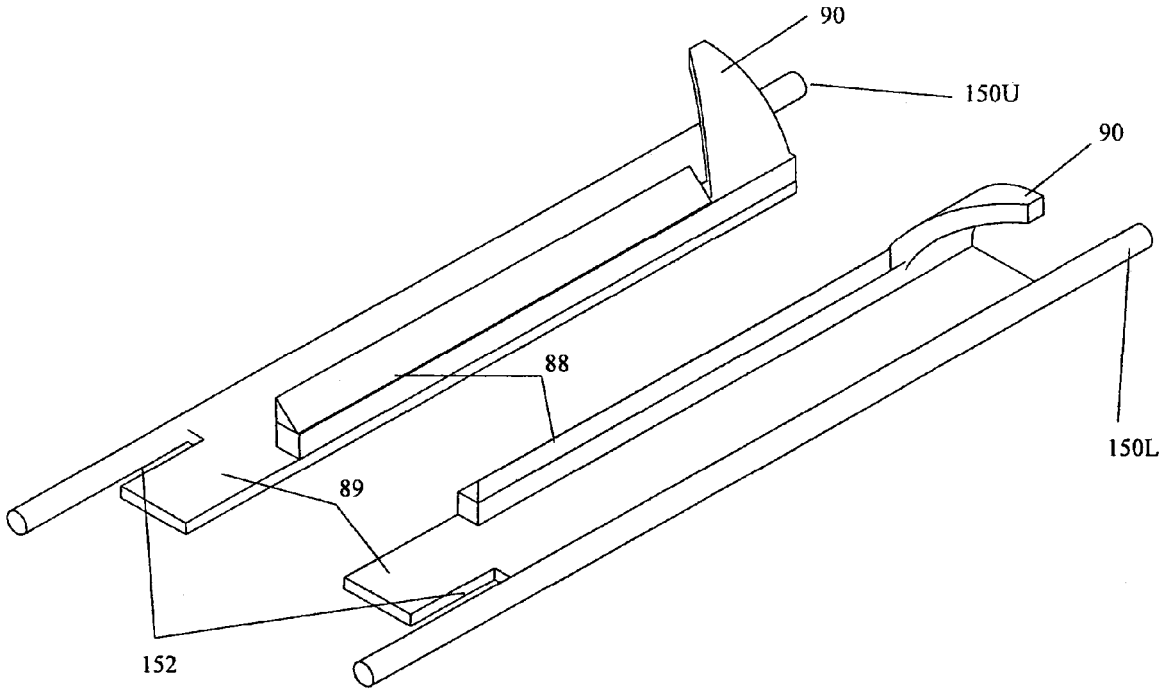
FIG. 22 shows the detail of the jaws of an alternate embodiment of the shell catcher of the present invention.
Figure 23:
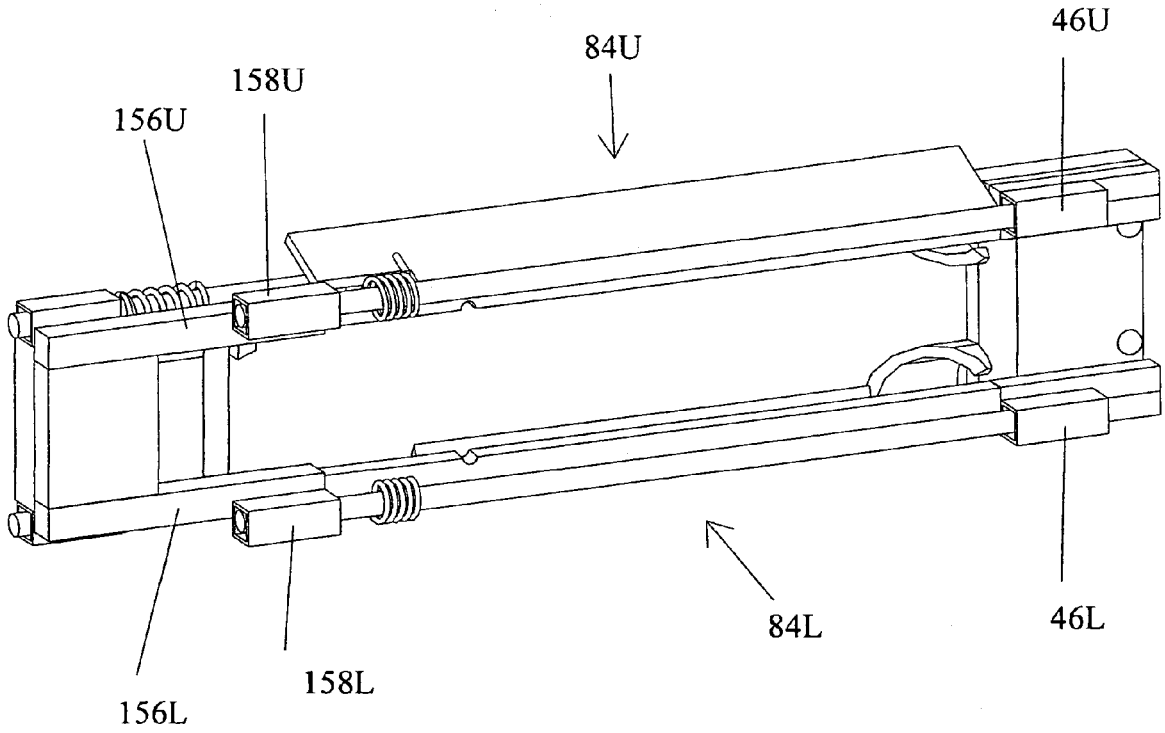
FIG. 23 shows an alternate embodiment of the shell catcher of the present invention showing an alternate design for attaching the jaws shown in FIG. 22.

FIGS. 22 to 23

Additional Embodiments

FIGS. 22 and 23 show various views of an additional embodiment of the present invention where jaws 84U and 84L are not pivotally attached to rails 36U and 36L. In this embodiment jaws 84U and 84L are comprised of jaw shafts 150U and 150L from which lip supports 89 extend laterally (FIG. 22). At the rear portion of lip support 89 is torsion spring gap 152 which separates the rear section of lip support 89 from jaw shaft 150U and 150L. Alternatively, torsion spring gap 152 can be located on the forward end of jaw shafts 150U and 150L and torsion springs 148U and 148L installed accordingly.

Above anterior rail hole 68 in each projection 46U and 46L of anterior base 32 are anterior jaw shaft bearings 154 which are of sufficient length and diameter to receive the forward ends of jaw shafts 150U and 150L. See FIG. 23.

Extending forward from the upper and lower portions of posterior base 34 are extensions 156U and 156L which support the rearward ends of rails 36U and 36L and which also support posterior jaw shaft bearings 158U and 158L which are of sufficient length and diameter to pivotally receive the rearward ends of jaw shafts 150U and 150L. See FIG. 23. Posterior jaw shaft bearings 158U and 158L can also be attached directly to the upper surface of posterior base 34 without the need for extensions 146U and 146L. In this embodiment the rearward ends of jaw shafts 150U and 150L and rails 36U and 36L would have to be extended accordingly.

FIGS. 24-31

Alternative Embodiments

Figure 24:
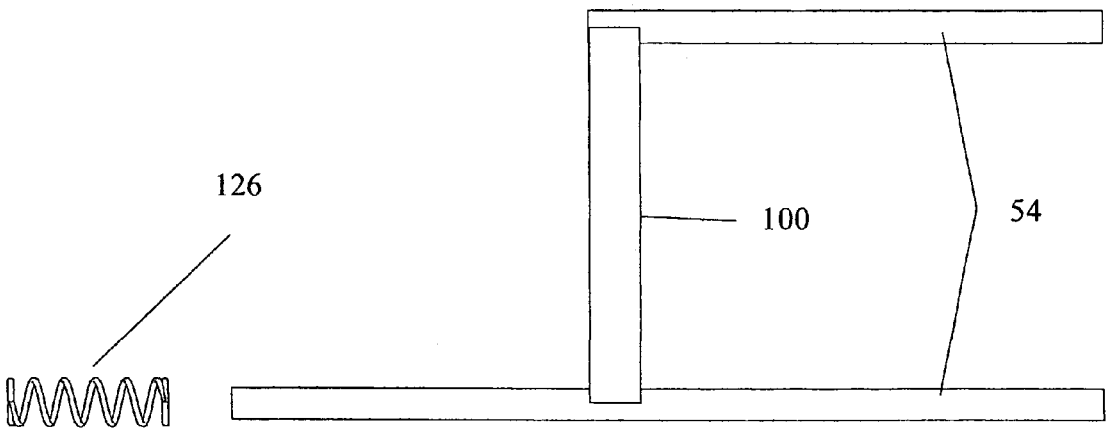
FIGS. 24 & 24A show alternate embodiments of the jaw trigger.
Figure 24A:
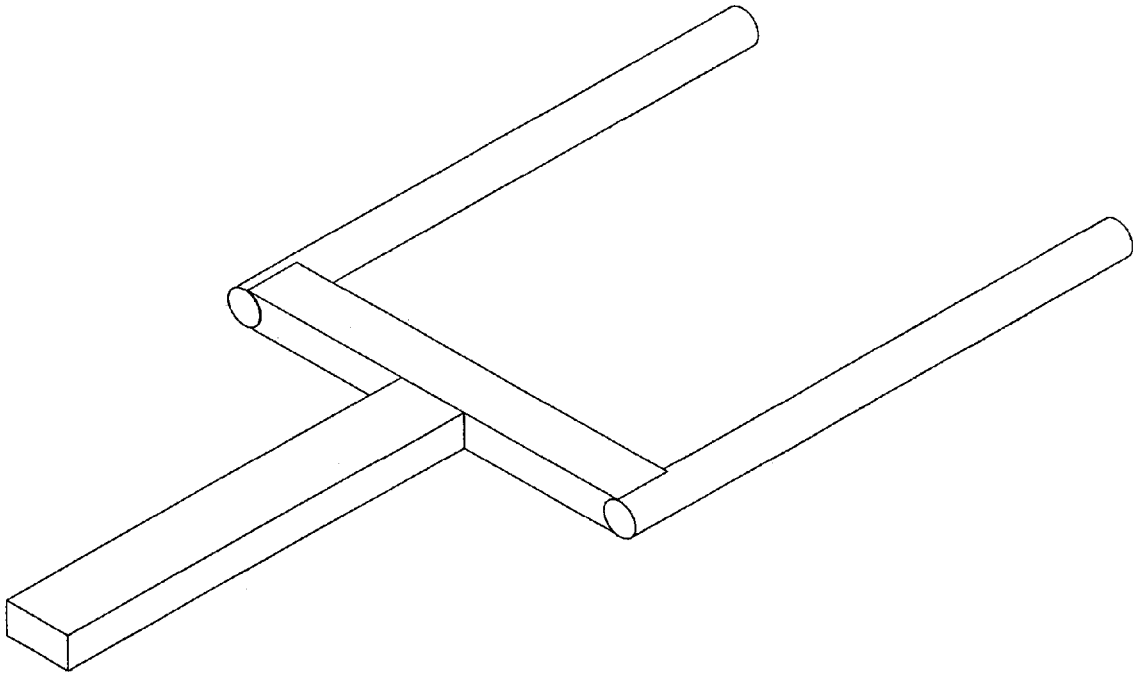

An alternative embodiment uses a modified jaw trigger which utilizes an upper jaw trigger shaft which does not have a portion extending rearward of jaw trigger cross member 100. This allows the upper and rearward portion of posterior base 34 to be trimmed for a more streamlined profile the contours of which more closely follow the guns receiver. A similar embodiment utilizes a jaw trigger with a single rearward jaw trigger shaft extending from jaw trigger cross member 100. In these configurations a non-round cross-sectional rear shaft prevents jaw trigger 98 from rotating or twisting. See FIGS. 24 and 24A.

Another embodiment uses a modified jaw trigger which has jaw trigger shafts which only extend forward of jaw trigger cross member 100 and which slide through and are supported by bearings. This embodiment also incorporates a leaf spring which engages the rear edge of jaw trigger cross member 100 instead of utilizing compression springs.

A further embodiment utilizes a jaw trigger cross member with offset ends which accommodates compression springs 126 and allows for the overall length of the invention to be reduced accordingly. See FIG. 25.

Figure 26:
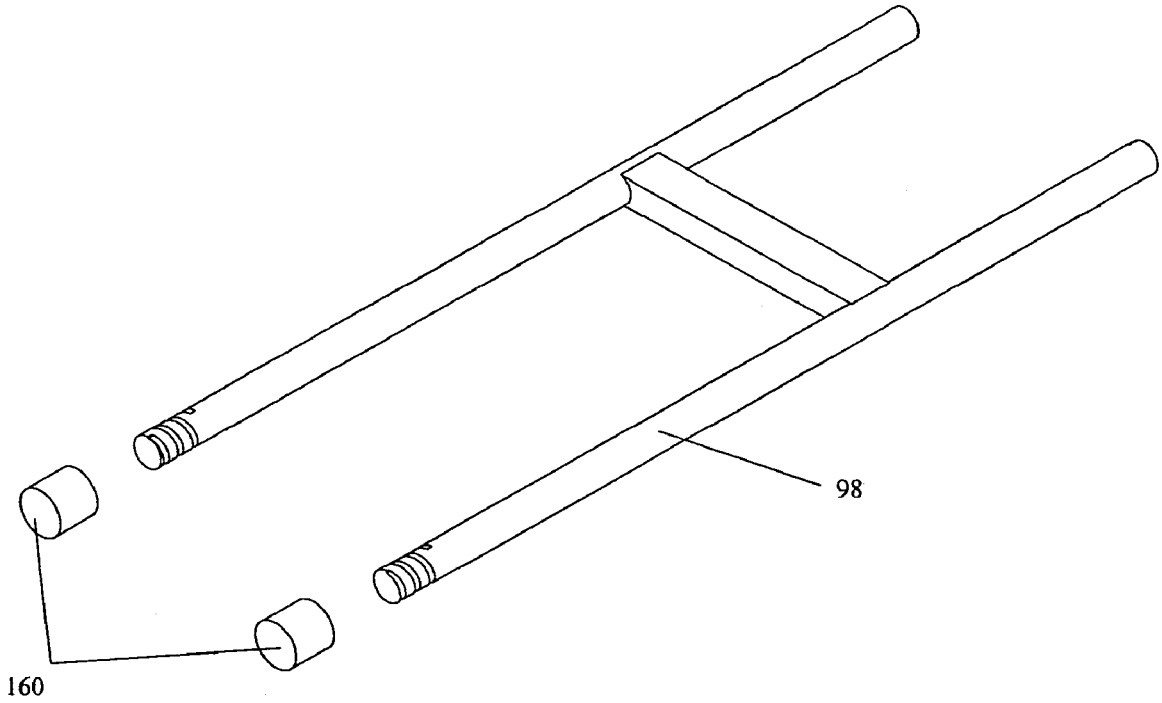
FIG. 26 shows an alternate embodiment of the jaw trigger with stops on the rearward ends of the jaw trigger shafts, which embodiment obviates the need for jaw trigger retention member 56.
Figure 27:
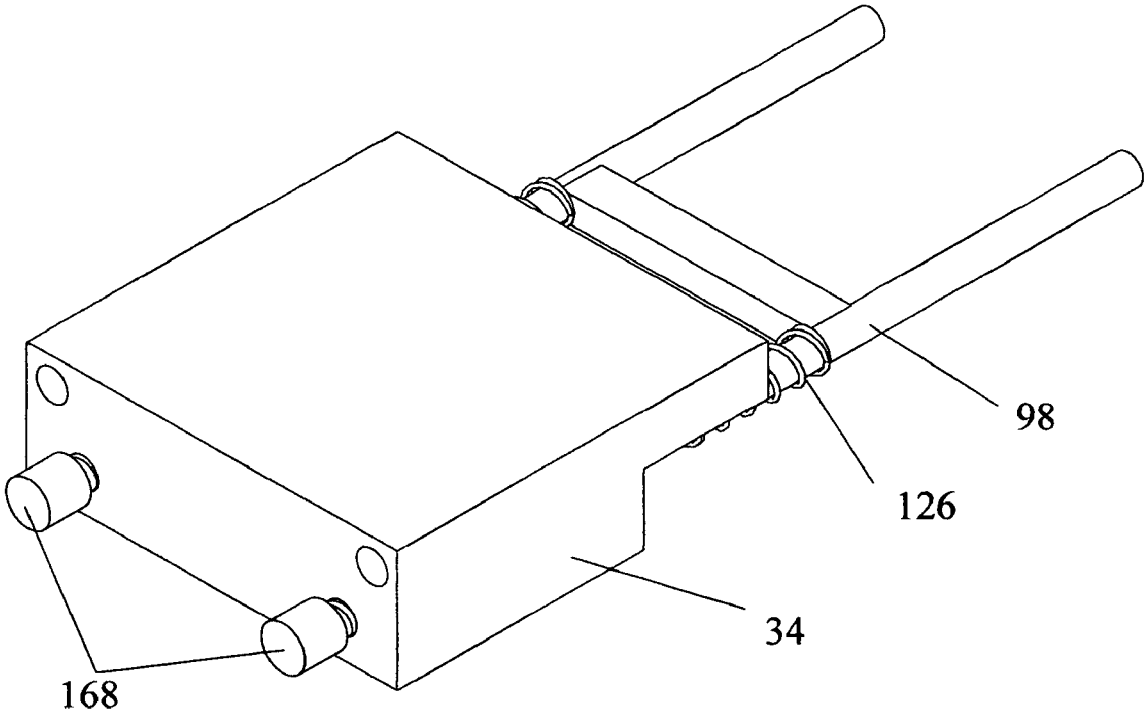
FIG. 27 shows a perspective view of posterior base 34 without jaw trigger retention member 56 and with the alternate jaw trigger embodiment shown in FIG. 26.

Another embodiment utilizes jaw trigger stops 160 on the rearward ends of jaw trigger shafts 54. See FIG. 26. Jaw trigger stops 160 limit the forward travel of jaw trigger 98 and thereby eliminate the need for jaw trigger retention member 56. See FIG. 27.

Figure 28:
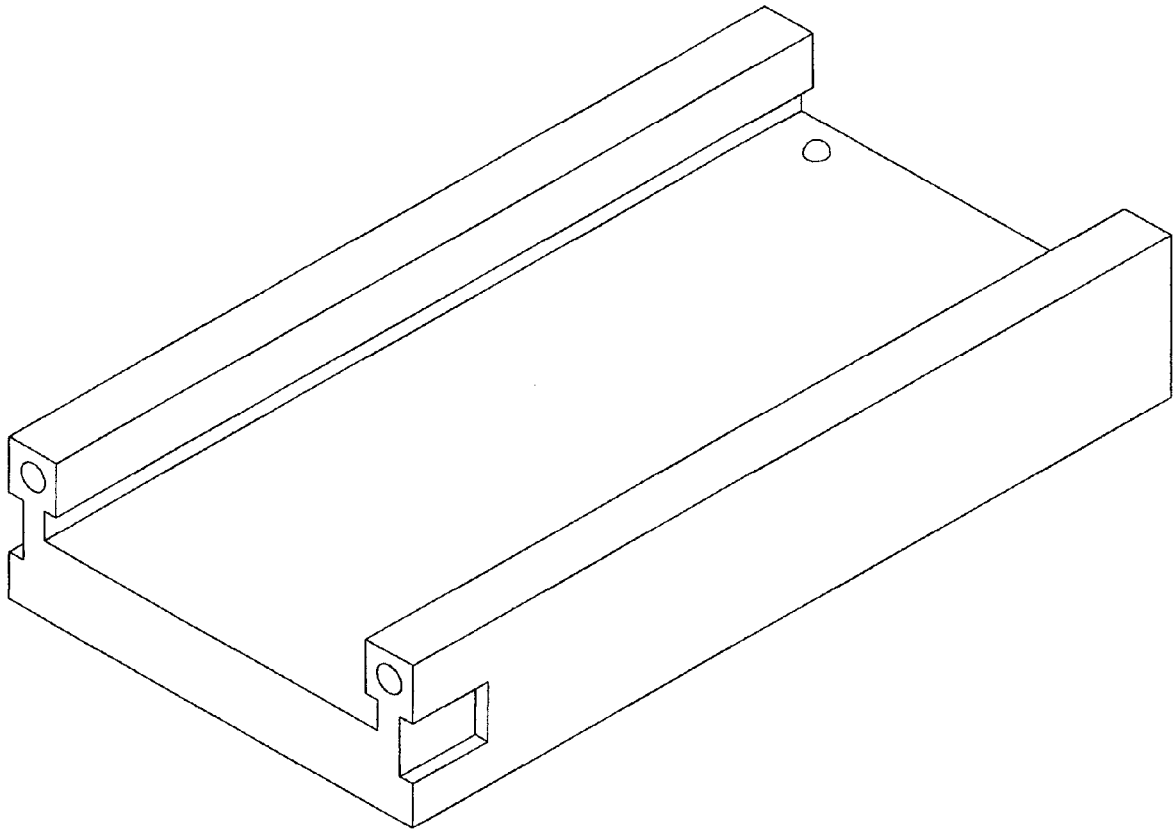
FIG. 28 shows an alternate embodiment of the anterior base extended to hold more than one spent shell.

Another embodiment utilizes an extended anterior base 32 with a parking area 40 capable of holding two or more spent shells which may be straight or of angled/curved shape. See FIG. 28.

Another embodiment replaces latch 102 with a screw or other equivalent fastening means which goes through posterior base 34 and threads into posterior dovetail 60 which is adhesively or mechanically attached to the guns receiver.

Another embodiment uses flush mounted screws/bolts rather than an adhesive means to attach anterior dovetail 38 and posterior dovetail 60 to the receiver by means of shallow threaded holes properly located in the receiver.

Another embodiment uses multiple smaller dovetails and slots rather than a single anterior/posterior dovetail/slot arrangement.

Another embodiment uses any of the foregoing dovetail/slot attachment means but with a "T" or other functionally equivalent cross sectional shape rather than a "dovetail" cross sectional shape.

Another embodiment uses any of the foregoing dovetail/T type and corresponding slot attachment means oriented vertically rather than horizontally to allow for attachment/removal of the invention in an upward or downward direction rather than forward and backward.

Another embodiment uses a spring loaded ball to attach the invention to the anterior and/or posterior dovetail. The ball partially extends above the upper surface of anterior dovetail 38 and/or posterior dovetail 60 and engages an indentation on the underside of anterior dovetail slot 72 and/or posterior dovetail slot 58.

Another embodiment does not utilize any dovetail/T type and corresponding slot or spring loaded ball arrangement to attach the invention to the gun but only an adhesive or mechanical means, such as a screw or bolt, to attach the device directly to the receiver.

Figure 29:
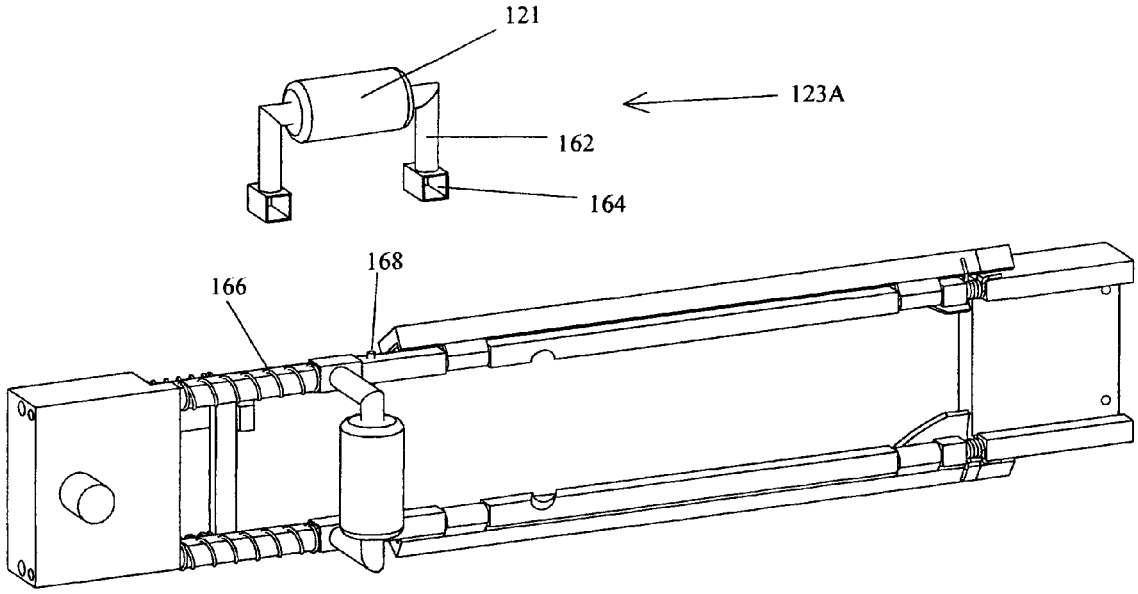
FIG. 29 shows an alternate embodiment of the shell damping feature.

Another embodiment utilizes an alternative design for shell damping device 123. See FIG. 29. In this embodiment, shell damping device 123A, the vibration damping/shock absorbing material 121 is attached to the center section of an inverted U shaped member 162. The ends of each leg of said member engage the rearward ends of rails 36U and 36L by means of slides 164 which allow shell damping device 123A to slide on rails 36U and 36L. Inverted U shaped member 162 is of sufficient height so that it does not interfere with the movement of parking handle 116 which passes underneath.

Damper compression springs 166 are mounted on rails 36U and 36L and push shell damping device 123A forward until it engages damper stops 168 which limit its forward travel. The position of damper stops 168 can be changed in order to change the position of shell damping device 123 on rails 36U and 36L and thereby provide an adjustment means. In this embodiment shell damping device 123A can be temporarily displaced rearward so that it doesn't interfere with the shooters cocking of the breech bolt. Shell damping device 123A can also be fixedly attached to rails 36U and 36L by set screws or other appropriate means.

Figure 30:
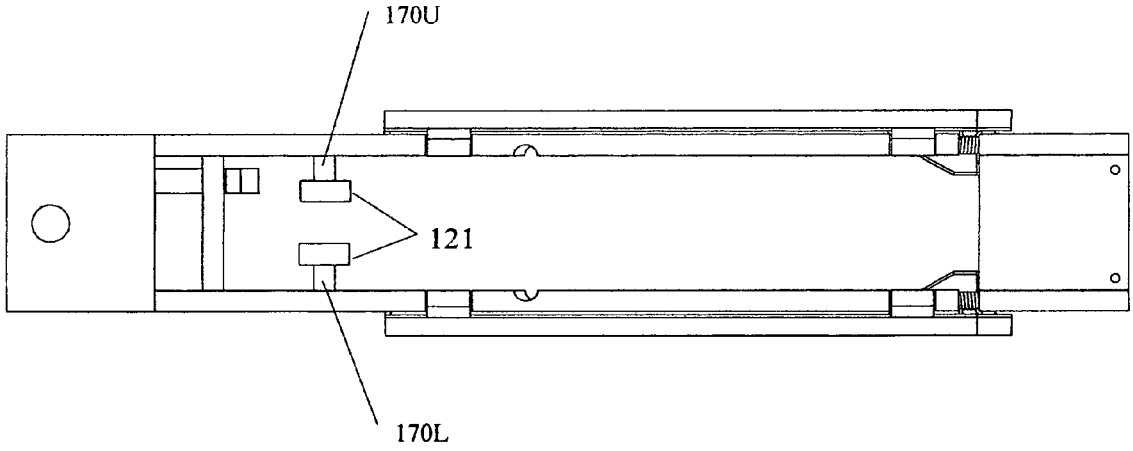
FIG. 30 shows a further alternate embodiment of the shell damping feature.

Another embodiment utilizes two bumpers 170U and 170L extending inward from each rail 36U and 36L each of which bumper has a cap composed of vibration damping/shock absorbing material 121. The space between each bumper 170U and 170L is sufficient to allow parking handle 116 to pass between them but not a spent shell. See FIG. 30.

Figure 31:
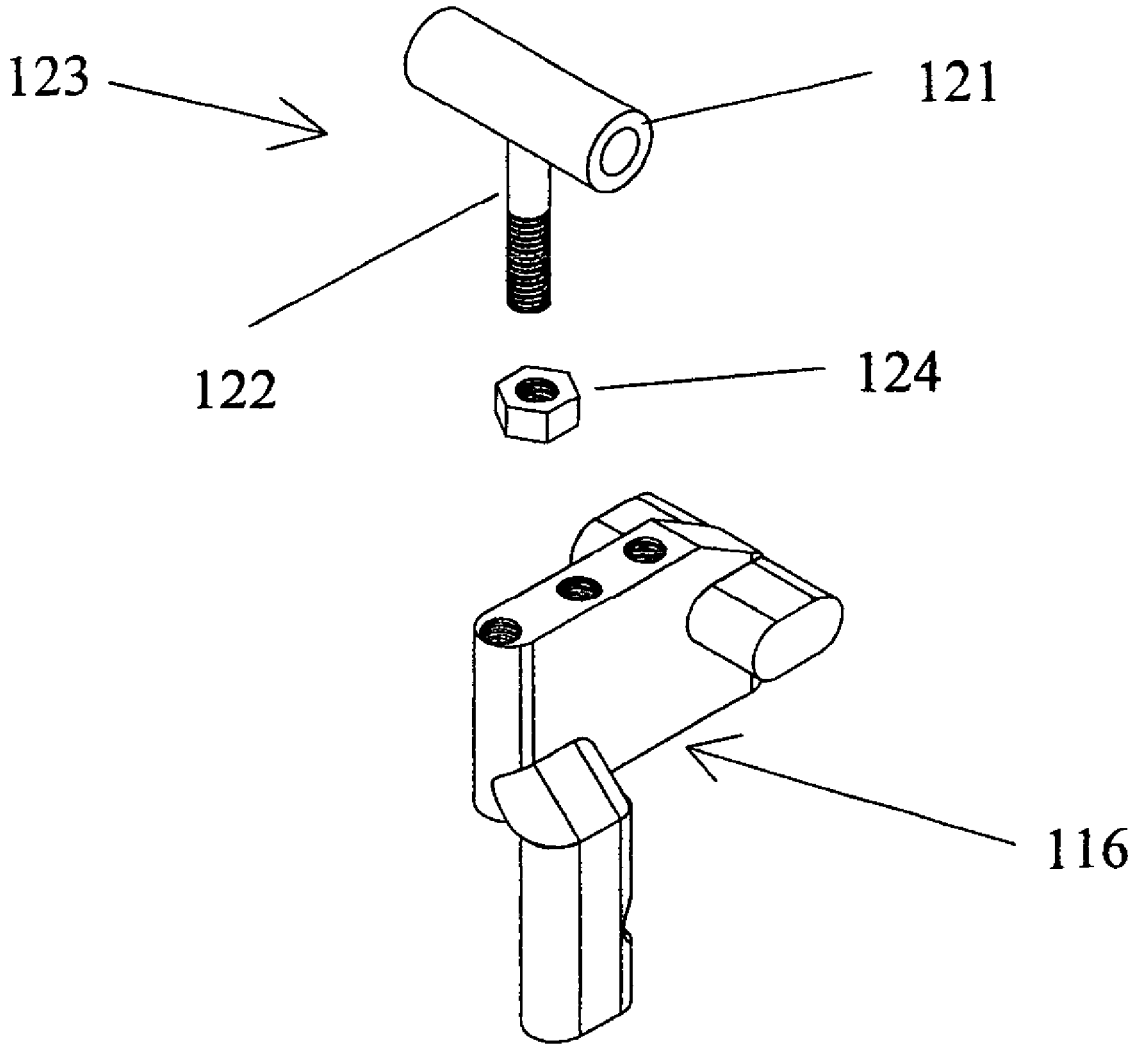
FIG. 31 shows a further alternate embodiment of a portion of the shell damping feature.

Another embodiment utilizes a "T" shaped shell damping feature 123 which incorporates a short cross bar into the upper end of rod 122 which is then covered by appropriately shaped vibration damping/shock absorbing material 121. See FIG. 31.

A further embodiment incorporates a lower profile design whereby jaw trigger shaft holes 52 are on or near the same plane as rails 36U and 36L thereby allowing the use of a "thinner" more low profile design. In this embodiment rests 96 are extended/enlarged in order that they engage jaw trigger shafts 54 appropriately in order to provide a large enough gap between the open/cocked jaws to allow a spent shell to pass through.

ADVANTAGES

From the description above, significant advantages of my single and/or multiple shell catcher become apparent:

(a) Single and/multiple spent shells can now be caught and retained in a manner which does not interfere with the normal operation of an autoloading gun.

(b) Autoloading guns will be much more popular with shooters who reload their own ammunition as even multiple fired spent shells can now be easily and conveniently caught and retained.

(c) Single and/or multiple spent shells can now be caught and retained in a manner which does not interfere with the shooters field of view or his or her ability to track moving targets with the gun in the mounted position.

(d) Single and/or multiple spent shells can now be caught and retained for proper discarding or reloading by the shooter which will significantly reduce the volume of spent shell litter which occurs at shooting ranges and other areas where recreational shooting and/or hunting occurs, significantly alleviating environmental concerns regarding such undesirable litter.

(e) Single and/or multiple spent shells can now be easily caught and retained by a means which does not impair the dynamic balance of a gun.

(f) Single and/or multiple spent shells can now be quickly and easily caught and retained by a means which does not detract from the aesthetic appearance of a gun.

(g) Single and/or multiple spent shells can now be easily caught and retained by a means which is easily attached to and removed from a gun.

(h) Single and/or multiple spent shells can now be easily caught and retained by a device which can be conveniently, easily and precisely positioned on a gun.

CONCLUSIONS, RAMIFICATIONS, AND SCOPE

Accordingly, as is evident from my above patent, the single and/or multiple spent shell catcher of this invention can be used to catch single and/or multiple spent shells in a quick, easy and convenient manner. In addition the shell catcher can be easily and precisely positioned on the gun and also can be quickly and easily removed from the gun when its use is not desired. Furthermore the shell catcher has the additional advantages in that:

it does not interfere with the normal use or operation of the gun;

it does not impair a guns dynamic balance;

it does not impair the shooters ability to view a target, and it does not detract from the overall appearance of a gun.

Although the foregoing description contains many specificities, these should not be construed as limiting the scope of the invention but merely as providing illustrations of some of the presently preferred embodiments of this invention. For example the shell catcher and/or its components can have shapes other than as depicted such as round, triangular, or polygonal, etc. The materials from which the invention is made can consist of metal, plastic, wood, etc. or any material of sufficient rigidity or flexibility as may be required.

Thus the scope of the invention should be determined by the appended claims and their legal equivalents, rather than by any of the examples contained herein.

I claim:

1. In combination, an autoloading gun and means for catching, clearing and retaining ejected shells and automatically resetting said catching, clearing and retaining means in order to catch, clear and retain a subsequent ejected shell.

2. The device in claim 1 wherein said means for catching, clearing and retaining ejected shells and automatically resetting said catching, clearing and retaining means further includes:

a. a plurality of pivoting jaw members with cam features and associated torsion spring members which engage said pivoting jaw members under spring tension applied thereby;

b. one or more base members which pivotally support said jaws in relation to the ejection port of said autoloading gun, limit the pivot range of said jaws, retain ejected shells caught by and cleared from said jaws which said base members include a sliding jaw trigger member and associated compression spring members which engage said jaw trigger member under spring tension applied thereby and which jaw trigger member holds and releases said pivoting jaw member in order to catch an ejected shell;

c. a parking handle member which is attached to the breech bolt of said autoloading gun and reciprocates therewith during the autoloading and shell ejection cycle of said gun.

3. A self-clearing shell catching device for catching one or more fired shells ejected from an autoloading gun comprising:

a. a plurality of pivoting jaws and means for attachment to a gun at spaced locations relative to the ejection port of the gun;

b. means for actuating said pivoting jaws into shell catching and shell holding/stabilizing positions;

c. means for clearing a caught shell from said pivoting jaws and retaining said caught shell and resetting said jaws, whereby the device catches an ejected shell which is then automatically cleared and retained and the device is reset in order to catch a subsequent ejected shell.

4. The self clearing shell catching device in claim 3 wherein said pivoting jaws further includes a cam member and torsion spring member.

5. The self clearing shell catching device in claim 3 wherein said means for attachment of said jaws to said gun further includes one or more base members which pivotally support said jaws in relation to the ejection port of said gun and also include a parking area to retain an ejected shell which has been caught by and cleared from said jaws.

6. The self clearing shell catching device in claim 3 wherein said means for actuating said pivoting jaws into shell catching and shell holding/stabilizing positions further includes a sliding jaw trigger member and compression spring members.

7. The self clearing shell catching device in claim 3 wherein said means for clearing a caught shell from said pivoting jaws and retaining said caught shell and resetting said jaws further includes a parking handle member.

* * * * *